US005825139A

United States Patent [19]

Nuckolls et al.

[11] Patent Number: 5,825,139

[45] Date of Patent: Oct. 20, 1998

[54] LAMP DRIVEN VOLTAGE TRANSFORMATION AND BALLASTING SYSTEM

[75] Inventors: Joe Allen Nuckolls; Lily Li Lin, both of Blacksburg, Va.

[73] Assignee: Hubbell Incorporated, Orange, Conn.

[21] Appl. No.: 556,878

[22] Filed: Nov. 2, 1995

[51] Int. Cl.[6] ..... G05F 1/00

[52] U.S. Cl. ..... 315/307; 315/244; 315/209 CD; 315/240; 315/289; 315/DIG. 4

[58] Field of Search ..... 315/99, 100, 106, 315/105, 199, 209 CD, 219, 243, 244, 247, 258, 259, 283, 284, 289, 291, 307, 340, 347, DIG. 5

[56] References Cited

U.S. PATENT DOCUMENTS

| | | | |
|---|---|---|---|
| 3,249,807 | 5/1966 | Nuckolls et al. | 315/199 |
| 3,317,789 | 5/1967 | Nuckolls et al. | 315/194 |
| 3,678,371 | 7/1972 | Nuckolls et al. | 323/6 |
| 3,710,184 | 1/1973 | Williams | 315/227 |
| 3,857,060 | 12/1974 | Chermin | 315/99 |
| 3,917,976 | 11/1975 | Nuckolls | 315/258 |
| 3,963,958 | 6/1976 | Nuckolls et al. | 315/276 |
| 3,986,076 | 10/1976 | Rottier | 315/99 |
| 3,997,814 | 12/1976 | Toho | 315/200 |
| 4,015,167 | 3/1977 | Samuels | 315/99 |
| 4,017,761 | 4/1977 | Woldring | 315/99 |
| 4,209,730 | 6/1980 | Pasik | 315/290 |
| 4,378,514 | 3/1983 | Collins | 315/276 |
| 4,443,740 | 4/1984 | Goralnik | 315/284 |
| 4,562,381 | 12/1985 | Hammer et al. | 315/99 |
| 4,626,745 | 12/1986 | Davenport et al. | 315/179 |
| 4,859,914 | 8/1989 | Summa | 315/354 |
| 4,866,347 | 9/1989 | Nuckolls et al. | 315/158 |
| 4,885,507 | 12/1989 | Ham | 315/244 |
| 4,891,562 | 1/1990 | Nuckolls et al. | 315/277 |
| 4,914,354 | 4/1990 | Hammer et al. | 315/247 |
| 4,958,107 | 9/1990 | Mattas et al. | 315/289 |
| 4,994,718 | 2/1991 | Gordin | 315/240 |
| 5,047,694 | 9/1991 | Nuckolls et al. | 315/290 |
| 5,049,789 | 9/1991 | Kumar et al. | 315/289 |
| 5,055,747 | 10/1991 | Johns | 315/307 |
| 5,173,643 | 12/1992 | Sullivan et al. | 315/276 |
| 5,210,471 | 5/1993 | Nuckolls et al. | 315/289 |
| 5,216,333 | 6/1993 | Nuckolls et al. | 315/291 |
| 5,289,084 | 2/1994 | Nuckolls et al. | 315/247 |
| 5,289,110 | 2/1994 | Slevinsky | 323/301 |
| 5,309,065 | 5/1994 | Nuckolls et al. | 315/205 |
| 5,321,338 | 6/1994 | Nuckolls et al. | 315/290 |
| 5,327,048 | 7/1994 | Troy | 315/240 |
| 5,389,857 | 2/1995 | Abbott et al. | 315/94 |
| 5,396,152 | 3/1995 | Bonigk | 315/241 R |
| 5,406,174 | 4/1995 | Slegers | 315/219 |
| 5,406,175 | 4/1995 | Speaker | 315/276 |
| 5,463,284 | 10/1995 | Mattas | 315/240 |
| 5,477,113 | 12/1995 | Christoffersson | 315/278 |

FOREIGN PATENT DOCUMENTS

| | | |
|---|---|---|
| 0018077 | 2/1977 | Japan . |
| 0018078 | 2/1977 | Japan . |
| 0049678 | 4/1977 | Japan . |
| 0098066 | 8/1979 | Japan . |

OTHER PUBLICATIONS

Philips Lighting, "IFS 800 Lighting Control System" Oct. 1990.

Ruud Lighting, "There's One System That Makes Two Level Lighting Simple" 1993.

*Primary Examiner*—Robert Pascal

*Assistant Examiner*—Haissa Philogene

*Attorney, Agent, or Firm*—Jerry M. Presson; Stacey J. Longanecker

[57] ABSTRACT

A discharge lamp operating circuit is connected to a source of alternating current (AC) voltage, and has a discharge lamp and a semi-resonant circuit connected to the source of alternating current voltage and in series with the lamp. A starting circuit for initiating operation of said discharge lamp is also connected in the circuit. The lamp switching maintains the series semi-resonant circuit in oscillation and the series semi-resonant circuit maintains the lamp in operation after operation has been initiated by the starting circuit. Highly efficient energy transfer between inductive and capacitive components of the system result in low loss and high power factor.

26 Claims, 11 Drawing Sheets

LAMP DRIVEN VOLTAGE TRANSFORMATION AND BALLASTING SYSTEM

FIELD OF THE INVENTION

This invention relates to a discharge lamp driving circuit which uses the lamp as a switch to create the voltage necessary to drive the lamp in normal operation.

BACKGROUND OF THE INVENTION

Whenever the line or supply voltage is less than the open circuit voltage (OCV) required to operate a gas discharge lamp, the supply voltage magnitude to the lamp must be increased in order to drive the lamp into operation. There must also be some technique to start and restart the lamp, either hot or cold. The required starting voltage is greater than the lamp operating voltage.

Many different systems have been devised to provide this required operating lamp voltage. The conditions described above, wherein the supply voltage is less than the OCV required for lamp operation, are common because the lowest usable voltage is normally employed for reasons of economy and availability at the application site. One normally uses the highest lumen-per-watt output lamp which is often one of the higher voltage lamps. The lighting systems must be consistent with the lighting requirements and must be operable on the available line voltage. If a 120 VAC supply is available, lamps of certain types up to some known wattage level and lumen output can be operated; for the newer, more efficient metal halide lamps and higher wattage lamps, one must arrange for a higher lamp supply voltage such as 240–530 VAC, which may not be available.

In these circuits, there are certain basic components, in addition to the lamp itself, which are present, including some form of ballast to control or limit the operating current level and lamp power. A semiconductor switching circuit is typically used to step up the source voltage to provide the required operating voltage. A lamp starting circuit is normally present and it is common to switch this starting circuit out of operation, or minimize its influence, after the lamp has entered its normal operation mode.

Stated differently, a lamp operating circuit most often includes a power source, which is normally a low-voltage AC source, some circuit means for controlling the amount of wattage which is delivered to the lamp, and the lamp itself. The circuit usually includes other components for special purposes such as power factor control.

Lamp operating circuits of the prior art have relied upon switching devices such as SCRs, TRIACs, transistors or the like to do some of the voltage transformation and control switching, and many of these circuits have included complex and expensive collections of circuits and components. The more components that are used, the more attention that must be paid to the problems associated with heat dissipation and circuit failure rates and life. It is therefore desirable to minimize the number of such components.

It is also very desirable, especially in high wattage lamp circuits, to have a high operating power factor for the lamp and the operating circuit. This is sometimes a problem with circuits using large inductive devices, and many circuits of the prior art include capacitive devices to correct the power factor. Switching circuits that are used in lamp operating circuits most often generate a poor power factor and high line harmonics condition.

SUMMARY OF THE INVENTION

In accordance with an aspect of the present invention, a driving circuit, for a discharge lamp is provided which uses a minimum number of components and which employs the switching characteristics of the lamp itself for circuit operation for driving the lamp.

A further aspect of the present invention is a lamp operating circuit which is highly efficient and which thus reduces energy loss and heat dissipation associated with a selected level of light output, as compared with circuits of the prior art, and operates with a high power factor.

Yet another aspect of the present invention is a highly efficient method of starting and operating a high intensity discharge (HID) lamp using a minimum number of components.

Briefly described, the invention includes a discharge lamp operating circuit connected to a source of alternating current (AC) voltage. The circuit has a discharge lamp, an inductor L and a capacitor C in which switching operations intrinsic to the lamp shock-excite the inductor L and the capacitor C into an energy exchange and transfer during each half-cycle at a higher frequency than the frequency of the AC source. The inductor L and capacitor C are connected in series with the lamp, and a circuit is provided for initiating operation of the discharge lamp. Switching of the lamp maintains the half-cycle operation, and the energy transfer circuit maintains the lamp in operation after operation has been initiated, even though the source voltage is less than the lamp operating voltage.

In another aspect, the present invention includes a discharge lamp operating circuit comprising a discharge lamp having a predetermined operating voltage or open circuit voltage (OCV), an inductive reactance, a capacitive reactance connected to a source of alternating current (AC) so that the reactances and the lamp are in a series circuit across the AC source. The AC source is capable of providing an AC voltage having an RMS (root mean square) voltage in a range which is less than the OCV required by the lamp. A starting circuit is connected to the lamp terminals. The inductance and capacitance values of the inductive and capacitive reactances are selected to be semi-resonant at a frequency higher than the frequency of the AC supply so that, after the lamp has been ignited, the lamp switches and causes a semi-resonant energy exchange with the reactances, thereby maintaining the lamp in a stable operating condition up to full rated wattage.

BRIEF DESCRIPTION OF THE DRAWINGS

In order to impart a full understanding of the manner in which these and other objects are attained in accordance with the invention, a particularly advantageous embodiment thereof will be described with reference to the following drawings, which form a part of this disclosure, and wherein:

FIGS. 16 and 17 are schematic circuit diagrams showing desirable arrangements of components for use of an embodiment of the invention in a residence or the like;

DESCRIPTION OF THE PREFERRED EMBODIMENTS

Metal halide (MH) lamps, even low wattage MH lamps, are 85 to 140 volt lamps and thus require OCVs of 216 volts or higher for starting and operation. Mercury vapor lamps are also 130–140 volt lamps. Hence, there exists a problem of trying to operate these various lamps from 120 volt power sources, and yet 120 volts is the most readily available line voltage where low wattage lamps are employed.

As previously mentioned, where the line or supply voltage is less than the open circuit voltage (OCV) required to operate a discharge lamp (e.g., a gas and/or vapor discharge lamp), the lamp driving voltage magnitude must be increased for lamp operation. The majority of discharge lamps require OCVs of 220 volts (AC, RMS) or greater. Therefore, the majority of conventional ballast circuits incorporate some sort of voltage step-up transformer means.

There are a variety of ballast circuit types known in the art which will not be discussed herein, primarily because the present invention eliminates the need for such circuits. A circuit in accordance with an embodiment of the present invention actually uses the discharge breakdown mechanism of the lamp itself at least once each half-cycle to excite a series-connected inductance and capacitance into ringing up to an instantaneous and RMS OCV of approximately twice the input line voltage to drive the discharge lamp. Furthermore, choosing the capacitance magnitude to limit the current through the lamp to the correct value permits one to set the lamp operating wattage to the correct value in accordance with the lamp ratings, i.e., the values established by the lamp manufacturer.

Figure 1:
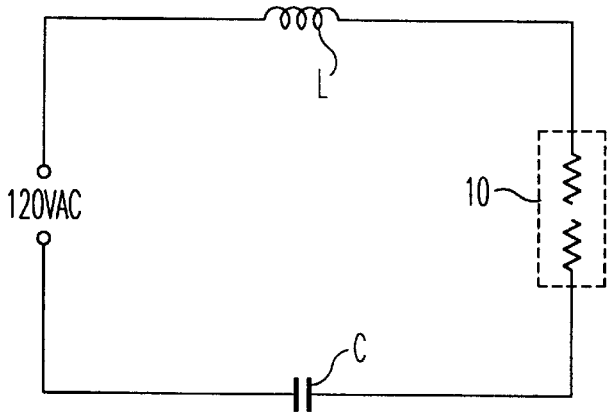
FIGS. 1 and 2 are schematic circuit diagrams of circuits usable to describe the principles of the present invention.

A basic, exemplary circuit which was used in the laboratory for demonstrating the principles of the present invention is shown in FIG. 1. This circuit was connected to a 120 volt AC supply to operate a General Electric 175 watt mercury lamp 10. However, other types of discharge lamps can be used such as a metal halide lamp, a mercury vapor lamp, a high pressure sodium lamp, or a fluorescent lamp, among others. It included an inductive reactor L, which was a ballast designed for use with a 150 watt HPS lamp, in series with the lamp 10 and a 30 $\mu$f capacitor C. This series circuit was connected directly across the supply line without any intervening transformers or other devices. The input was 120 volts at 1.53 amps, providing 169 watts at a power factor of 0.921. The lamp operating voltage was 131.2 volts and the lamp wattage was 164.5 watts. The voltage drops across L and C were 61.3 volts and 129.5 volts, respectively.

Figure 2:
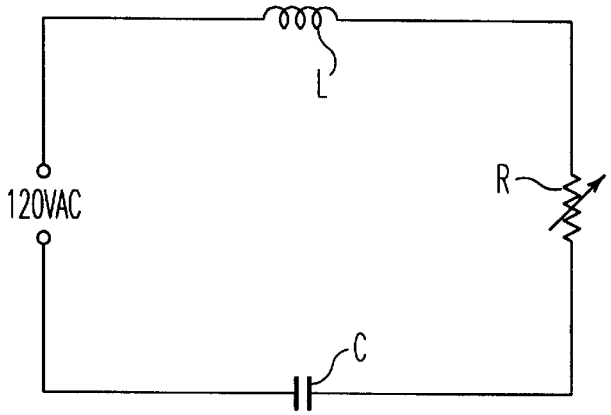

It should be noted that the measured lamp operating voltage was higher than the line voltage. The reason for this is that the lamp itself is the generator of its own driving voltage. This lamp operation is further illustrated by the circuit of FIG. 2, in which a resistor R was set to a value which is the equivalent of the effective resistance of the lamp 10 in FIG. 1 and was substituted for the lamp, the other circuit components being the same as in FIG. 1. In FIG. 2, the input voltage was 120.5 volts at 1.418 amps and provided 121.1 watts at a power factor of 0.708. The voltage across the resistor was 82.9 volts, significantly less than the voltage across the lamp in the circuit of FIG. 1 and less than the line voltage. It is known that a discharge lamp can operate as an open circuit, a short circuit, a rectifier, and a switch with an effective resistance, depending on the fill material (e.g., argon, neon and xenon) and the plasma (e.g., mercury, sodium) and control circuitry associated therewith. The difference between the circuits in FIGS. 1 and 2 is that the lamp in FIG. 1 switches the energy in the circuit to generate for itself the higher lamp driving voltage. The equivalent resistor in FIG. 2 only dissipates energy because it has no switching mechanism. The present invention employs a switching mechanism of the lamp that is intrinsic to the lamp and the materials (e.g., fill gas) that constitute it, and is not a separate element added internally or externally with respect to the lamp, to facilitate energy transfer with the inductor L and the capacitor C.

Figure 3:
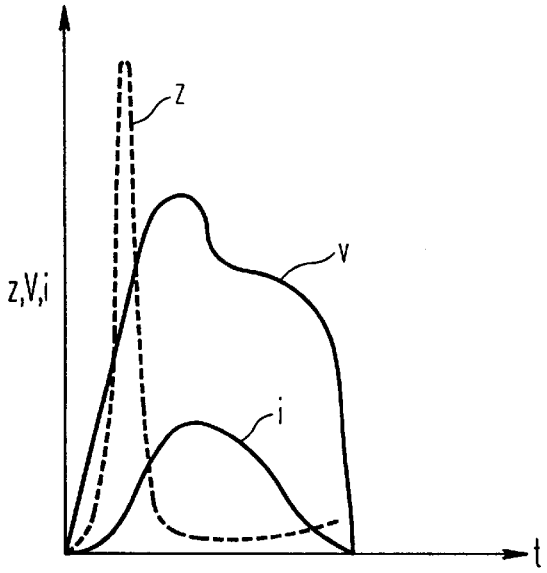
FIG. 3 is a graph illustrating impedance and volt-amp curves for a discharge lamp.

FIG. 3 illustrates impedance and voltage-ampere curves of an operating discharge lamp (i.e., a 400 watt high pressure sodium lamp, for example). The lamp resistance increases and then decreases rapidly and therefore is shown as a spike curve. Upon application of a required OCV, and after the resistance decreases, the lamp ionizes and conducts current as illustrated by the voltage-ampere curve. The voltage-ampere curve decreases to a negligible level until the lamp is energized again. As will be described below, the increase in lamp voltage causes the inductive reactor L and capacitor C to resonate, resulting in an energy exchange with the lamp wherein the lamp is again energized in accordance with the invention.

Figure 4:
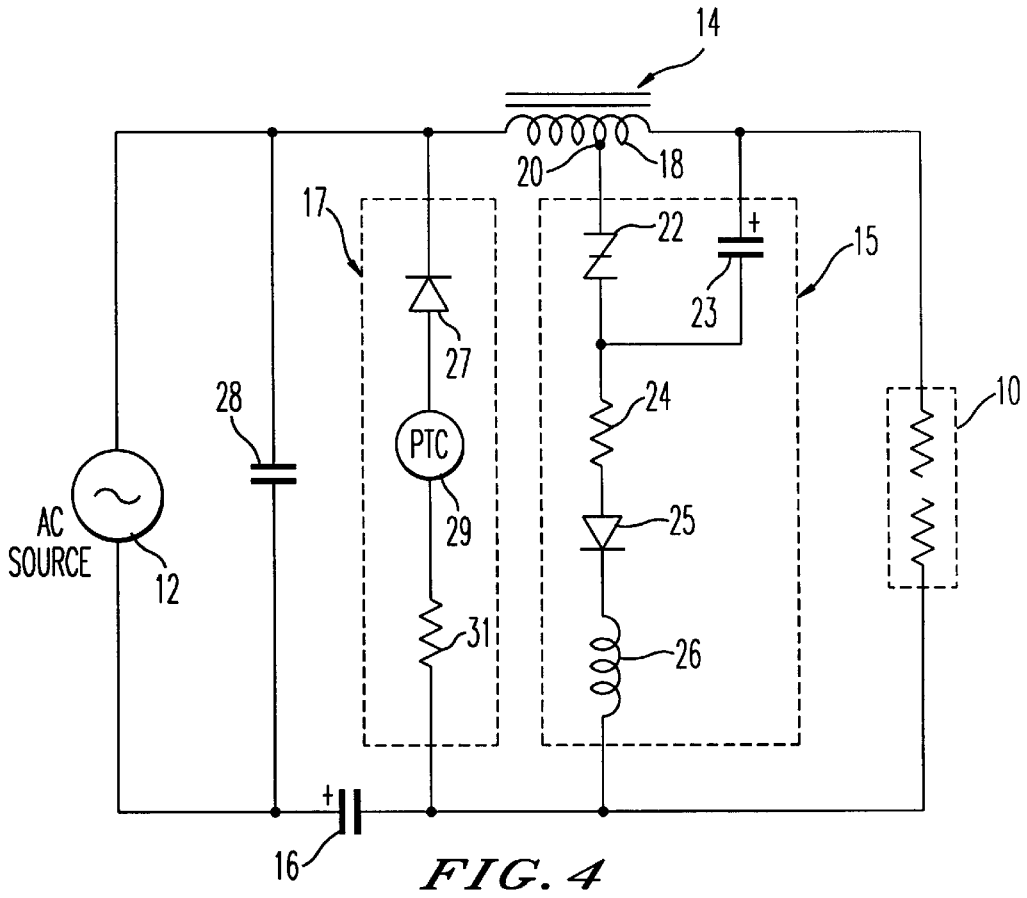
FIG. 4 is a schematic circuit diagram of a basic lamp operating or driving circuit in accordance with an embodiment of the invention.

FIG. 4 shows a basic circuit in accordance with the present invention for operating an HID lamp 10 of a type which has no internal starting electrode and which therefore requires high voltage pulse ignition. The circuit includes an AC source 12, an inductor 14 and a capacitor 16, which are all connected in series with lamp 10. With properly selected values for the inductive reactor and capacitor, as will be discussed below, this is the basic driving and operating circuit of the present invention.

The circuit of FIG. 4 includes a starting circuit which uses a portion 18 of reactor 14 between a tap 20 and the end of the reactor winding. A breakover discharge device such as a Sidac 22 and a capacitor 23 are connected in series with each other and in parallel with portion 18. A resistor 24 is connected to the junction between the Sidac and capacitor 23 and is in series with a diode 25 and a radio frequency (RF) choke 26, the choke being connected to the other side of lamp 10 to which capacitor 16 is connected. This forms a high voltage (H.V.) pulse starting circuit 15. This H.V. pulse starting pulsing circuit 15 is driven by a second starting circuit 17 that produces a voltage higher than the input voltage source on the order of $\sqrt{3}\times V_{in}$ OCV. This higher-than-line voltage produces across the lamp the required lamp starting OCV, as well as higher energizing voltage for the H.V. pulse starting circuit 15. This circuit 17 is usable with lamps either having or not having an internal starting electrode.

The second charging circuit 17 includes a diode 27, a positive temperature coefficient (PTC) resistor 29 and a fixed resistor 31 connected in series between the input side of inductor 14 and the lamp side of capacitor 16. The circuit 17 can also include a small bypass capacitor 28 to shunt high-frequency energy generated by the starting circuit past the AC source and to the lamp.

Briefly, this starting circuit comprising circuits 15 and 17 operates by charging capacitor 23 through resistor 24, diode 25 and choke 26 during successive half-cycles in a direction determined by the polarity of diodes 25 and 27. The AC supply is 120 volts, and therefore is not sufficient to drive the high voltage pulse starting circuit 15 up to the breakdown voltage (240 volts, for example) of the Sidac. Further, the AC supply does not provide sufficient OCV to permit the lamp to pick up, i.e., to cause a breakdown in lamp impedance, which in turn causes enough current to be drawn to heat the electrodes and be positively started and warmed up. When the AC supply is turned on, the capacitor 16 charging loop charges capacitor 16 up to $\sqrt{2}$ of the RMS source voltage (i.e., $\sqrt{2}\times V_{in}$ RMS) in the first half-cycle through the PTC circuit 17 because the cold resistance of the PTC resistor is low, typically 80 Ω. Resistor 31 is used to limit the peak inrush current through the charging loop components, especially the PTC resistor. Diode 27 is poled to charge capacitor 16 as shown. On the next half-cycle, the charge on capacitor 16 adds to the source voltage (twice the peak value, without loading) and drives capacitor 23 charging current through diode 25. When the charge on capacitor 23 exceeds the breakover voltage of the Sidac, the Sidac becomes conductive and capacitor 23 discharges through portion 18 of the reactor, causing high voltage to be developed across the entire reactor by autotransformer action. Thus, a high voltage lamp ignition pulse is placed on top of the intermediate ($\sqrt{3}\times V^{in}$) OCV which positively starts and stabilizes the lamp arc. The choke 26 is included to be sure that high-frequency high voltage appears only across the lamp and not on the starting circuit components.

Once the lamp 10 draws real power follow-through, having been forced by the intermediate OCV, the PTC resistor 29 heats up and its resistance increases to a high level (typically 80 kΩ or more). Capacitors 16 and 23 are effectively removed from starting circuit operation, although capacitor 16 continues to be involved in semi-resonant circuit operation in conjunction with inductance 14. All of the lamp starting mechanism is effectively removed from the system and does not interfere with the warming-up lamp and fully-on lamp operation where the lamp is supplying the switching action described herein. These starting functions are automatically tied together with each other (intermediate OCV and pulse generation) and the lamp condition at that point in time.

Note also that when input power is interrupted, the lamp restarts in approximately 2 to 3 minutes because, when the lamp is not drawing current (is deionized), capacitor 16 is charged up and the PTC heating current drops to below heating levels. The PTC 29 thus cools rapidly to a low resistance state in which the lamp starting process is allowed to occur again. When the lamp is operating normally and drawing normal current, normal AC voltage appears across capacitor 16. Thus, all of the lamp ionization, starting and operating function generators are automatically slaved to each other and to the lamp's state.

The circuit of FIG. 4 is particularly useful for operating a 100 watt medium base metal halide lamp made by Venture Lighting International, Inc., of Solon Ohio. This lamp is rated to have a 9000 lumen output. Its operating characteristics are given in the following table. The lumens per watt is 86 compared with 82.6 for a 100 watt 120 volt HPS lamp.

TABLE 1

| Lamp type: 100 Watt mercury | | | | | | | |
|---|---|---|---|---|---|---|---|
| Circuit values: | | L = 0.22 H | | C = 15 μf | | Tuning freq. 87.7 | |
| $V_{in}$ | $I_{in}$ | $W_{in}$ | P.F. | $V_{1p}$ | $I_{1P}$ | $W_{1p}$ | $W_{loss}$ |
| 120 | 1.13 | 104.1 | 0.77 | 100.7 | 1.13 | 97.3 | 6.8 |

In the operating circuit itself, the selection of the values of the inductor 14 and capacitor 16 is particularly important. These circuit values are chosen to allow semi-resonant operation of the reactors 14 and 16 at a frequency which is higher than and compatible with the frequency of the source. By "semi-resonant", it is meant that the reactors 14 and 16 are not self-resonant, but are resonant when the switching lamp 10 excites them and therefore are capable of being shocked by the switching action of the lamp itself to cause a resonant energy exchange between the inductive and capacitive reactors and the switching lamp. The lamp is excited by current pulses generated by the reactors 14 and 16 following each half-cycle excitation by the lamp. The reactors operate at a higher frequency than the source frequency to generate current pulses in each half-cycle of the power source. This is a fundamental principle of the operating system of the present invention.

It is well known that a series resonant circuit includes an inductor having an inductance L, a capacitance C and some resistance R, mostly the resistance of the inductive component, which is usually kept as small as possible for best circuit operation. A series resonant circuit with component values suitably chosen resonates at some frequency $f_0$ which is called the frequency of resonance. At $f_0$, the impedance of the circuit is minimum and at other frequencies the impedance is higher. At resonance, $$2\pi f_o L = \frac{1}{2\pi f_o C} \tag{1}$$

The most efficient energy transfer takes place when the impedances of the effective energy source and the energy dissipator are equal. These are the conditions which exist in a resonant circuit, as well as in the semi-resonant circuit of the present invention wherein the lamp-switched energy exchange between the L-C elements 14 and 16, the voltage source 12 and lamp load 10 is responsible for the operating current through the lamp. The efficiency of the circuit depicted in FIG. 4 is therefore very high, as is the power factor. Within each half-cycle of the source 12, the lamp 10 switches the current passing through it, and also switches the semi-resonant circuit (i.e., reactors 14 and 16), "shocking" the semi-resonant circuit into semi-resonance during each half-cycle of the power frequency.

Figure 5:
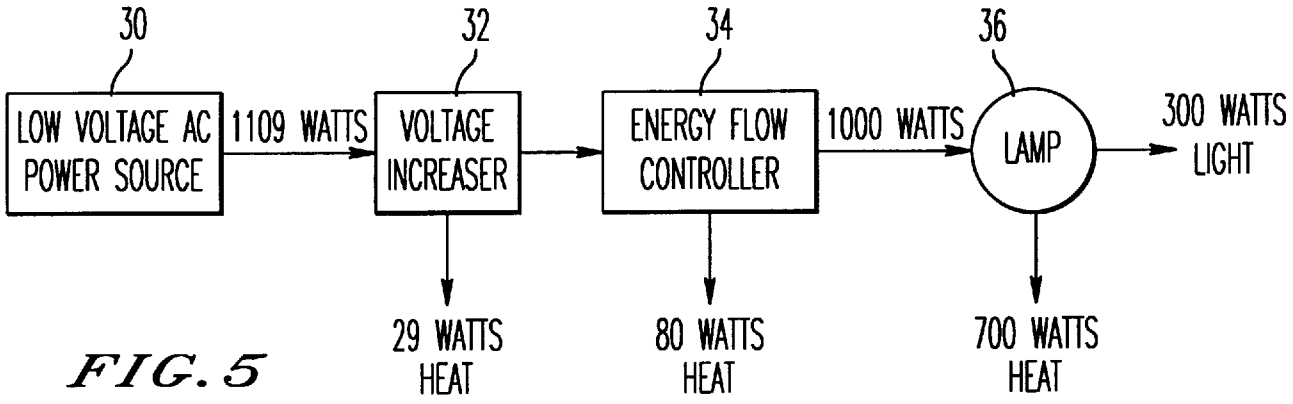
FIG. 5 PRIOR ART
FIG. 5 is a functional block diagram illustrating the movement of energy in a conventional lamp operating circuit.

FIG. 5 is a block diagram of the energy flow for a conventional operating circuit for a 1000 watt, metal halide HID lamp. For this example, the lamp 36 to be energized is a 1000 watt metal halide lamp. The purpose of this diagram is to explain the energy flow and energy losses in a conventional system for comparison with the system of the invention. A low voltage AC power source 30 supplies about 1109 watts of power to a device 32 which is for the purpose of increasing the voltage to the lamp. In a conventional circuit, this voltage increaser is typically a high-loss transformer device which loses about 29 watts in the form of heat. The remaining 1080 watts is delivered to a device 34 which controls the amount of energy which is allowed to flow to lamp 36. Typically, this is a ballast which loses a minimum of about 80 watts in the form of heat. The remaining 1000 watts are supplied to the lamp which generates about 300 watts in the form of light, the remaining 700 watts being lost as heat. The amount of energy lost as heat in the lamp itself is, of course, a function of the efficiency of the lamp itself and has nothing to do with the operating circuit. Although HID lamps are notably inefficient, they are nevertheless the most efficient, presently known, practical converter of electrical energy into light. The significant fact about this flow diagram is that about 109 watts are lost in the operating circuit as heat from components 32 and 34.

Figure 6:
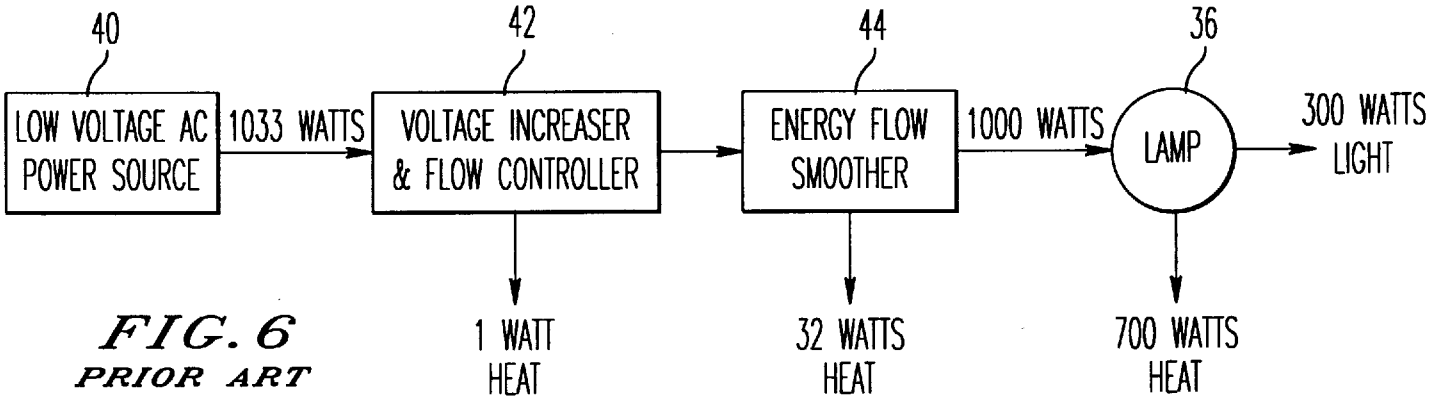
FIG. 6 PRIOR ART
FIG. 6 is a functional block diagram illustrating the movement of energy in a lamp operating circuit in accordance with the present invention.

FIG. 5 can be compared with the energy flow diagram of FIG. 6 which shows essentially the same kind of information as FIG. 5, except as it applies to the operating circuit of the present invention. Again, the goal is to supply 1000 watts of energy to MH lamp. To do this, a low voltage AC supply 40 provides about 1033 watts to a voltage increaser and flow controller 42 (i.e., the semi-resonant circuit capacitor C). Device 42 loses only about 1 watt in the form of heat and performs the functions of devices 32 and 34 of FIG. 5. The remaining 1032 watts is provided to an energy flow smoothing device 44 (i.e., the semi-resonant circuit inductor L) which loses about 32 watts in the form of heat. This leaves 1000 watts to be provided to lamp 36 which produces light with the same efficiency as in FIG. 5. It will be recognized that the system of FIG. 6 exhibits a very significantly improved efficiency insofar as the operating circuit itself is concerned, losing only 33 watts as compared to 109 watts with a typical prior art circuit. In addition, the lamp operating circuit of the present invention (e.g., the circuit depicted in FIG. 4) allows improved lamp designs having higher lumens per watt (LPW).

Figure 7:
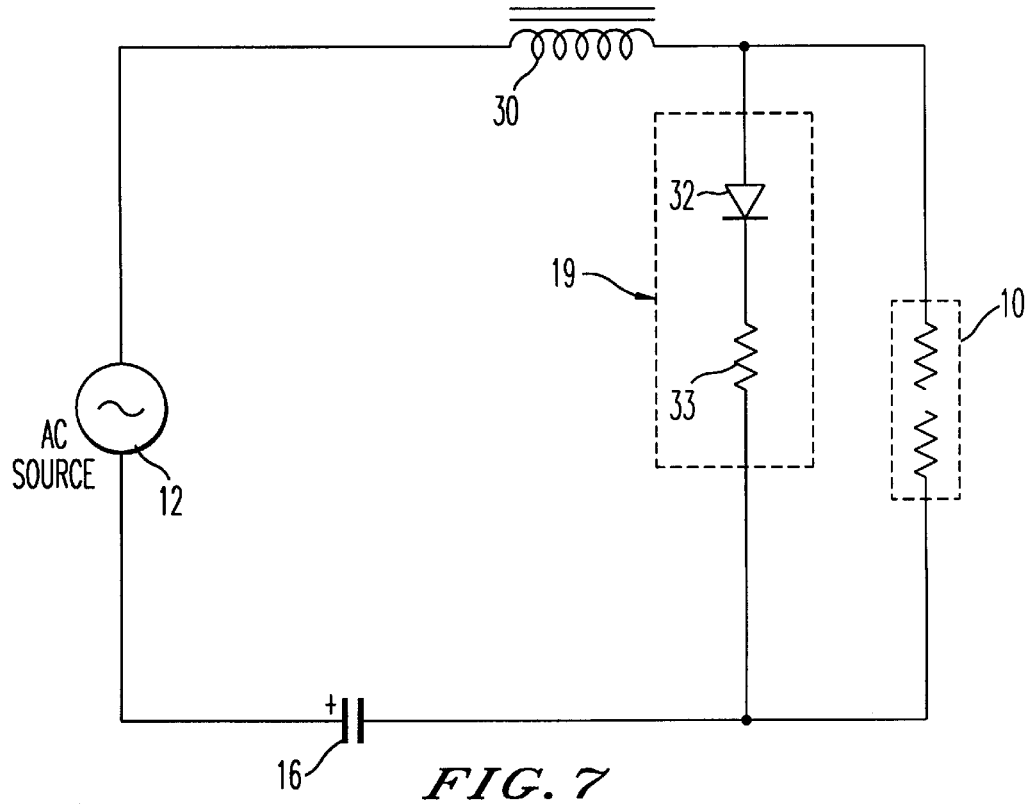
FIG. 7 is a schematic circuit diagram of a lamp operating circuit in accordance with an embodiment of the invention with a starting circuit usable with a lamp of the type having an internal starting electrode.

FIG. 7 is a schematic diagram of a further embodiment of a discharge lamp operating circuit constructed in accordance with an embodiment of the present invention. It comprises a different and simpler starting circuit 19 that can be used if the lamp being operated has an internal starting electrode and does not require high voltage pulses for initial ionization. The circuit of FIG. 7 provides an RMS OCV of $\sqrt{3}\times V_{in}$ and a peak voltage of $2\sqrt{2}\times V_{in}$ for lamp starting. As is well known in this art, lamps of certain types, such as mercury vapor and metal halide lamps, made by various manufacturers, are made with a starting electrode adjacent one main electrode of the lamp but electrically connected to the opposite main electrode, thereby producing a high field adjacent one electrode. Initially, an arc occurs between the one main electrode and the starting electrode. After a short interval of ionization of the fill gas at one electrode which has the high field, the ionization spreads from electrode to electrode within the lamp, an internal bimetallic switch shorts out the starting electrode after the lamp heats up to prevent electrolyses of the sodium and mercury. In FIG. 7, the AC source 12 is connected to an inductive reactor 30 which is in series with lamp 10 and with capacitor 16. In this circuit, the reactor 30 does not have a tap, or the tap, if present, is not used.

The starting circuit 19 includes a diode 32 in series with a current limiting resistor 33 and is connected in parallel with the lamp. When the source 12 is on, current flows through diode 32 and resistor 33 to charge capacitor 16 in each half-cycle of the AC source, effectively increasing the charge on the capacitor 16. After some number of cycles, depending on the magnitude of the source voltage, the value of the capacitor 16 and the resistor 33, the increased OCV ionizes the gas within the lamp and starts the lamp. This circuit 19 approximately doubles the half-cycle peak input voltage and the RMS magnitude by $\sqrt{3}\times V_{in}$. Thereafter, the starting circuit 19 is essentially inactive since the capacitor 16 never has an opportunity to charge to lamp starting voltage again as the lamp operating current overwhelms the charging current. The capacitor 16 and inductive reactor 30 are chosen to have values which resonate with lamp switching at a higher frequency than the supply frequency, as described in connection with FIGS. 1 and 4.

The following example relates to a 1000 watt metal halide (MH) lamp which is a type of lamp often used in groups to illuminate a stadium or, in less dense arrays, to illuminate the interiors of industrial and commercial buildings, aircraft hangers and manufacturing plants. The following data were collected using an exemplary circuit configured in accordance with FIG. 7, operated at the various supply voltages indicated in the following table. The inductive reactor 30 was a reactor designed for use with a 400 watt HPS lamp (in a conventional circuit) and has 0.116 Henries at 4.7 Amperes. A 31 $\mu$f capacitor 16 was used and the starting circuit resistor 33 had a value of 30 kΩ. The values are as follows:

$V_{in}$ is the input voltage in AC volts RMS $I_{in}$ is the input current in AC amps $W_{in}$ is the input power in watts P.F. is the power factor, $V_{lp}$ is the voltage across the lamp during operation, $I_{lp}$ is the lamp current, $W_{lp}$ is the power supplied to the lamp during operation, in watts, $W_{loss}$ is the circuit loss during operation, in watts, $V_c$ is the voltage across capacitor 16, and $V_l$ is the voltage across reactor 30.

TABLE 1

| $V_{in}$ | $I_{in}$ | $W_{in}$ | P.F. | $V_{1p}$ | $I_{1p}$ | $W_{1p}$ | $W_{loss}$ | $V_c$ | $V_1$ |
|---|---|---|---|---|---|---|---|---|---|
| 249 | 2.88 | 689 | .961 | 250.4 | 2.87 | 674 | 15 | | |
| 263 | 3.41 | 848 | .942 | 251.3 | 3.43 | 820 | 28 | | |
| 277 | 4.06 | 1037 | .920 | 260.4 | 4.05 | 1004 | 33 | 342 | 189 |
| 291 | 4.56 | 1191 | .898 | 272.8 | 4.52 | 1148 | 43 | 381.1 | 208 |
| 305 | 5.43 | 1406 | .846 | 272.1 | 5.43 | 1348 | 58 | 459.7 | 248 |

The various input voltages indicated in Table 1 were used to determine the exemplary circuit operating characteristics in response to voltage variations from the design input voltage, which is 277 volts, to evaluate the operation of the circuit under realistic conditions in which line voltage can vary significantly. It will be observed that the lamp continued operating under these conditions and that the lamp operating power remained close to the rated power. It will also be noted that the total circuit power loss varied between 2% and 4% of either lamp wattage or input volt-amperes, demonstrating that it is an efficient system. Note that the lamp voltage was close to the supply voltage.

The value of 31 $\mu$f for the capacitor was chosen to permit the circuit to deliver the correct wattage for the rating of this lamp, i.e., $$I_C = I_{lamp} = 2\pi f C V_C 10^{-6} \tag{2}$$

The value of L is chosen to give LC tuning at a frequency higher than the line frequency of 60 Hz to allow time in each half-cycle for the lamp-induced, natural tuned half-cycle resonant energy transfer to occur within the time interval of one half-cycle. Thus, selecting 84 Hz as the tuned frequency for this example, $$f_o = \frac{1}{2\pi\sqrt{LC}} = 84 \text{ Hz} \tag{3}$$

and the resulting frequency during actual circuit operation is higher than the line frequency of 60 Hz and lower than the tuning frequency of 84 Hz, as will be described below. The term "compatible frequency" is used to indicate that the circuit operates at a frequency above and close to, but not exactly at, the source frequency.

Because of the ability of the circuit to operate the lamp under conditions of supply voltage variation, there is no need for input voltage regulation devices which are large, heavy, and/or expensive and a source of considerable energy loss and reduced product life. While the use of such a device is not precluded in order to achieve closer control of color or the like, it is not necessary.

With all prior art lighting systems of this general type, a major consideration is how to package the lamp and its supporting electrical circuit components and heating problems. For a lamp rated to operate at 1000 watts or more, this is a serious problem because the components previously required to operate the lamp commonly occupy a volume of 1 to 2 cubic feet and generate enough heat to preclude the use of plastic housings and parts. However, with the system of the present invention, the component size can be reduced by approximately half. Further, the heat due to power loss is so drastically reduced that a much wider variety in housing sizes, materials and types is possible and economic.

Figure 8:
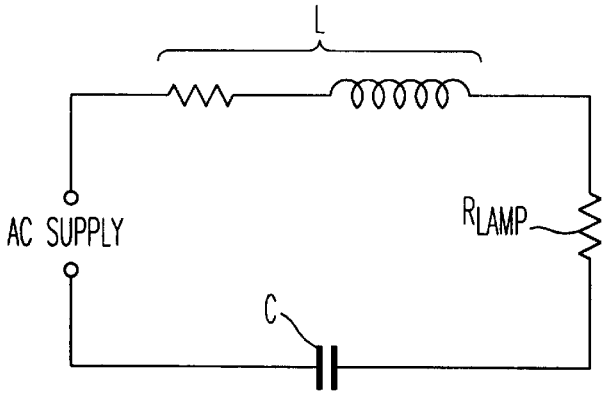
FIG. 8 is an equivalent circuit diagram useful in understanding the theory of operation of operating circuits in accordance with the present invention.

The following discussion will refer to FIG. 8 which shows a circuit according to the invention but with the components represented as individual impedances so that the design and operation characteristics can be discussed in a mathematical sense. In FIG. 8, the inductor L is represented by a resistor and a coil, the lamp is represented by an equivalent resistance R lamp and the capacitor by a capacitive reactance C. This circuit will be discussed using the 1000 watt MH lamp characteristics as an example. The values from the above table will be used corresponding to an input voltage of 277 volts.

The effective working impedance Z of the circuit is given by dividing the input voltage by the current, 277/4.06, which equals 68.2 Ω. However, it is also possible to calculate the impedance of the circuit in FIG. 8 using The resistance of $$\sim Z = R_{losses} + R_{lamp} + j(X_L - X_C) \tag{4}$$

the resistive portion of the inductor is equal to the watts lost divided by the square of the current, i.e., 33 divided by 16.48 which equals 2 Ω. The lamp resistance is found from the same relationship, i.e., 1004 divided by 16.48 which equals 60.9 Ω. $X_L$ is 43.7 Ω and $X_C$ is 85.7 Ω. Thus, $$\begin{aligned} \sim Z &= 2 + 60.9 + j(43.7 - 85.7) \\ &= 62.9 - j41.9 \\ &= \sqrt{(62.9)^2 + (41.9)^2} = 75.6\Omega \end{aligned} \tag{5}$$

If one calculates the current from the input voltage, 277 volts, divided by the calculated impedance, 75.6 Ω, the result is 3.66 A. This value is too low because the test results show that the actual current is 4.06 A. However, if the expression $I_{actual}$ =(1.1)V/Z is used, and if current is then recalculated as above, the result is a current of 4.03 A. This is very close to the measured value. Thus, the input voltage appears to be 10% higher than the measured value.

Note also that the total reactance $X_L + X_C$ can be reduced by 38% (on paper) which results in an effective impedance of 68.1 Ω. This is very close to the value needed to give a current of 4.03 A.

If the current value of 4.03 Ω obtained above is used, the power factor becomes 3.35/4.03=0.83 which is not right.

Therefore, what is happening in the circuit that gives the actual test values of 4.06 A. and a power factor of 92% is that the effective half-cycle frequency of the system is higher than the line frequency and that the reactance ($X_L + X_C$) drops due to the LC actual operating half-cycle frequency.

Referring back to the following total impedance equation, it will be recalled that the calculated value for $^{18}Z$ was (62.9−j41.9) Ω with 75.6 Ω being the non-vector magnitude, giving a current flow of 3.66 A. and a power factor of 83%. While this is based on the actual circuit values for L, C and R in the circuit, we know that these calculated values are not correct.

To make the impedance equation fit what is actually going on in the gas-discharge induced semi-resonant circuit of the present invention, the recalculation is as follows.

A total circuit impedance value of 68.2 Ω is required to meet the measured current flow of 4.06 A. and we know that the power dissipating resistance of 62.9 Ω cannot be changed, so the $^{18}Z$ equation becomes (62.9−j26) Ω which meets both the measured values of current and power factor, i.e., $$I^2R = (4.06)^2(62.9) = 1037 \text{ watts input.} \tag{6}$$

$$\sqrt{(62.9)^2 + (-26)^2} = 68.1\Omega \tag{7}$$

$$\frac{V_{in}}{Z} = \frac{277}{68.1} = 4.06A. \tag{8}$$

and, $$PF = \frac{62.9}{68.1} = 0.92PF, \tag{9}$$

which is consistent with the measured values.

The reactances $X_L$ and $X_C$ have measured voltage drops of 189 volts and 342 volts, respectively. Dividing these voltage values by the current 4.06 A. gives calculated values of 46.55 Ω (L) and 84.24 Ω (C). Combining these values gives a theoretical reactance of j(46.55−84.24) or −j37.69 Ω. However, we know that this total reactance is −j26 Ω.

Thus, the total reactance must be influenced by the semi-resonance induced by the switching lamp in this circuit whose mechanisms have already been defined. The $X_L$ and $X_C$ modifications can be described as follows.

$$j(X_L - X_C) = j\left(2\pi fL - \frac{1}{2\pi fC}\right) = -j. \tag{10}$$

Solving this expression for f with values of L=0.116 and $C=31\times10^{-6}$, gives a frequency, or switching rate, of f=68 Hz. This is not the same as the line frequency of 60 Hz, nor is it a value which would be obtained by solving the usual expression for resonant frequency using the known circuit values.

Figure 9:
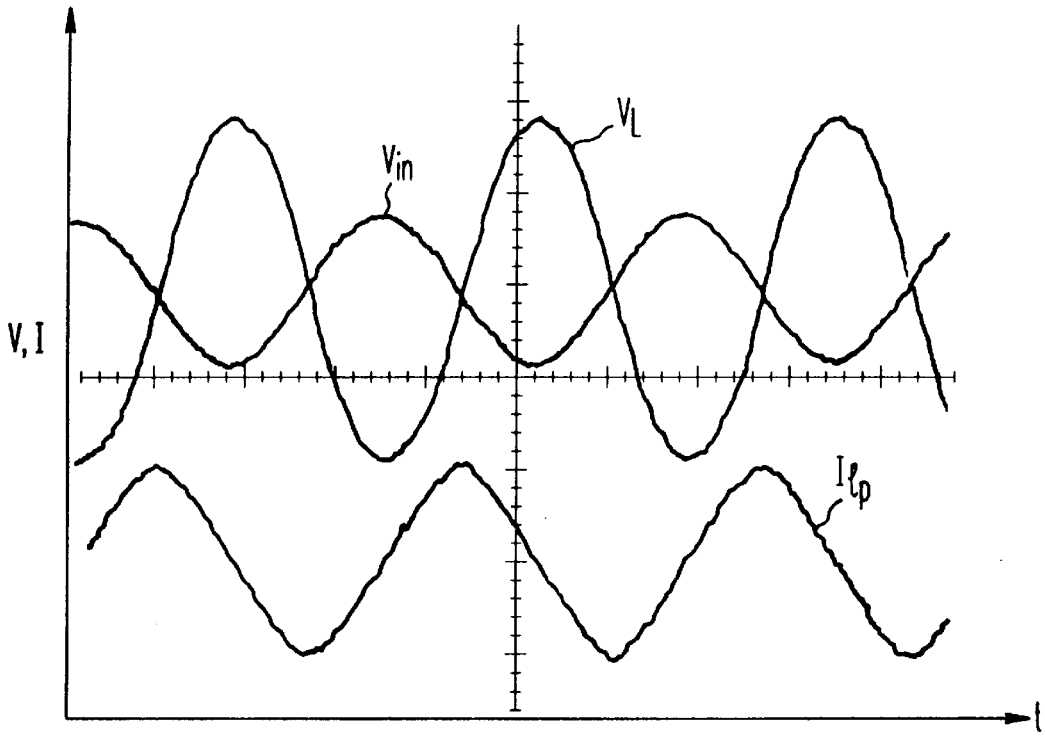
FIGS. 9–12 are illustrations of waveforms taken at specified locations in an embodiment of the present invention.
Figure 10:
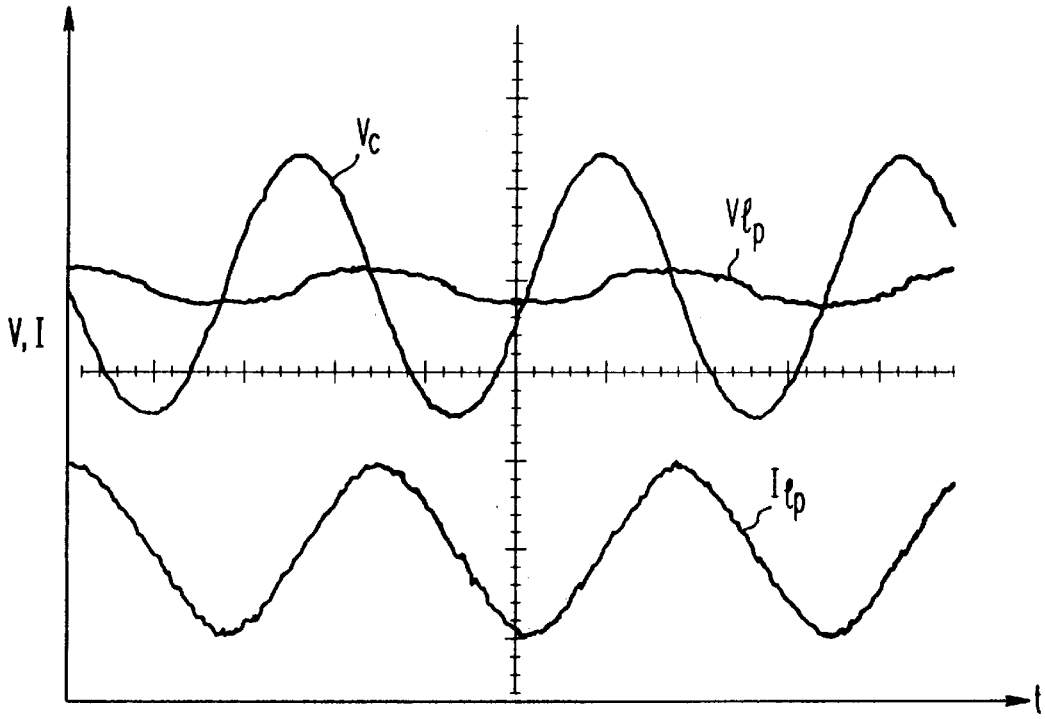
Figure 11:
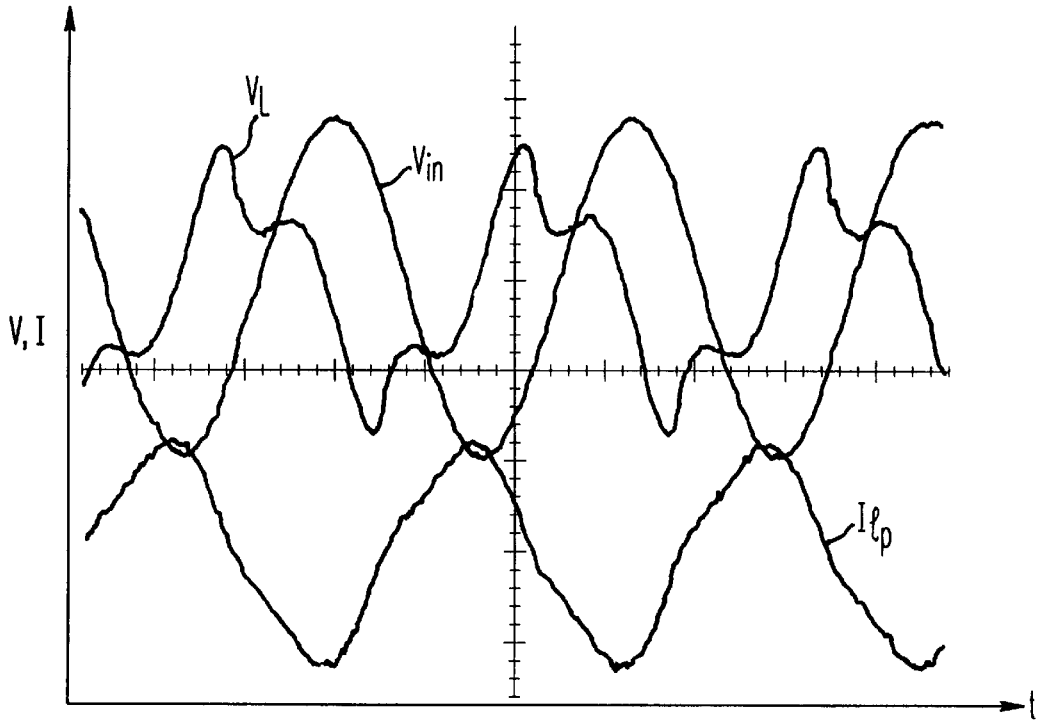
Figure 12:
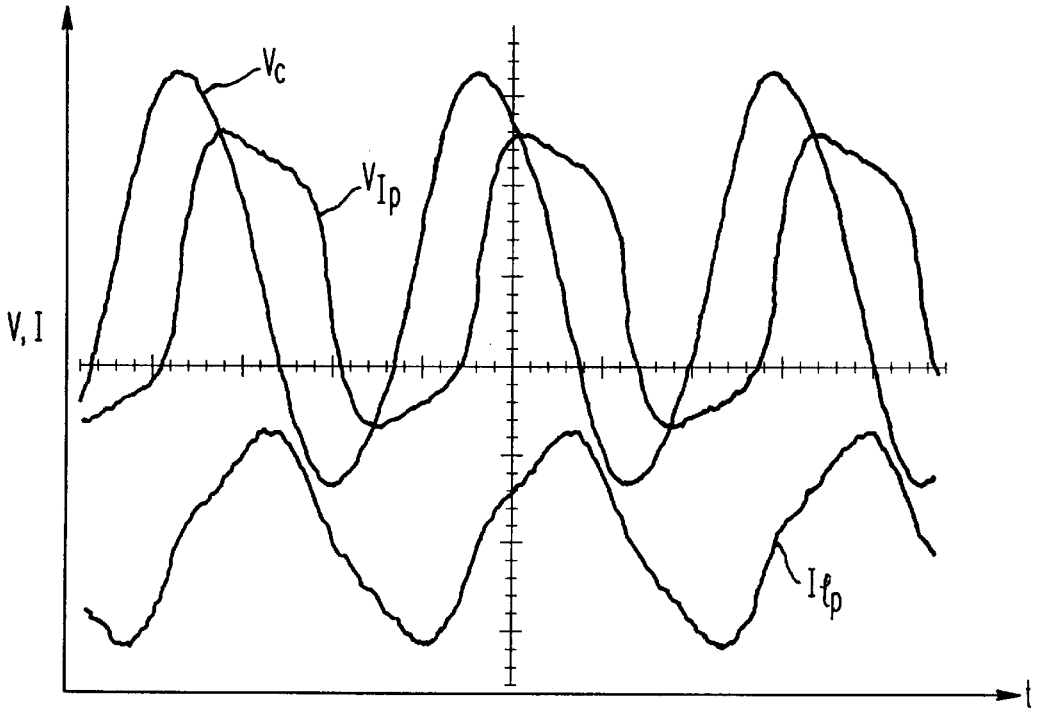

This tells us that the apparent operating frequency, or energy pulse transfer rate, is at a higher frequency than the line frequency during each half-cycle. The line frequency does not completely dictate the operating frequency of the system because the switching lamp mechanism each half-cycle shock excites the series LC network into a modified form of operation which, in effect, shifts the lamp's re-ignition instant forward within the half-cycle as a result of the circuit voltage amplification of the lamp driving voltage, as illustrated in FIGS. 9–12. The effective lamp driving OCV is Q times the normal OCV. FIG. 9 shows the input voltage Vin, voltage across the inductive reactor Vl and lamp $I_{lp}$ current at starting. FIG. 10 shows the capacitor and lamp voltages Vc and Vlp at starting, with the lamp current repeated for comparison. FIGS. 11 and 12 show these respective characteristics during operation.

Therefore the switching lamp circuit makes the $X_L$ appear to be ((68-60)/60) 100, or 13%, higher than the normal ωL value of 43.7 Ω and the $X_C$ magnitude to be (60/(68-60))× 100, or 7.5%, lower than the normal value of 85.7 Ω. This partly accounts for why this circuit is smaller and lower cost than a standard ballast.

Note also that this circuit causes the discharge lamp's operating power factor to be higher than is usually obtainable. A normal lamp PF is around 90% to 91%, but in this circuit the power factor is 1004/(260×4.06)=95.1%. This more closely resembles a resistor in its power dissipation mechanisms and quality.

Regarding efficient power transfer from the AC source to the lamp load, the circuit of the present invention satisfies the well-known theorem of Thévenin, which tells us that energy transfer between two electrical devices is maximum when the impedances of the two devices are equal. The lamp resistance is $(1004/(4.06)^2)=60.9$ Ω. The source impedance as seen by the lamp is $Z_0=(L/C)^{1/2}=(0.116/31\times10^{-6})^{1/2}=61.2$ Ω. These values are very close to being equal, which they should be the most energy efficient performance and highest operating power factor.

When selecting circuit values for a lamp, it is to be recognized that the values can be different for different lamps, i.e., a circuit; for a 1000 watt lamp made by one manufacturer has circuit values which may not be the best for a 1000 watt lamp made by another manufacturer because the switching characteristics of any lamp depend, in part, on the fill gas, the plasma components used, the composition and the lamp and electrode geometry. The most direct procedure is to select a capacitor which gives a current capable of supplying the rated current for the lamp using equation (2) above. Then the inductance is chosen so that the circuit is tuned to a resonant frequency above the line frequency and so that the circuit impedance is approximately correct. Some experimentation must then be done to find the frequency-inductance combination for most efficient operation of the lamp.

Following are some examples of circuit values for specific lamps.

TABLE 2

Lamp type: 40–50 watt Mercury, General Electric, rated 0.6 A.

| Circuit values: | | L = .408 H | | C = 7.5 μf | | Tuning freq. 91 Hz | |
|---|---|---|---|---|---|---|---|
| $V_{in}$ | $I_{in}$ | $W_{in}$ | P.F. | $V_{1p}$ | $I_{1p}$ | $W_{1p}$ | $W_{loss}$ |
| 120 | .562 | 50.6 | .749 | 100 | .558 | 45.6 | 5 |

TABLE 3

Lamp type: 80 watt mercury

| Circuit values: | | L = .28 H | | C = 12 μf | | Tuning freq. 86.8 Hz | |
|---|---|---|---|---|---|---|---|
| $V_{in}$ | $I_{in}$ | $W_{in}$ | P.F. | $V_{1p}$ | $I_{1p}$ | $W_{1p}$ | $W_{loss}$ |
| 120 | .88 | 87.4 | .819 | 105 | .88 | 80.1 | 7.3 |

TABLE 4

Lamp type: 175 Watt mercury

| Circuit values: | | L = .079 H | | C = 29 μf | | Tuning freq. 105.4 Hz | |
|---|---|---|---|---|---|---|---|
| $V_{in}$ | $I_{in}$ | $W_{in}$ | P.F. | $V_{1p}$ | $I_{1p}$ | $W_{1p}$ | $W_{loss}$ |
| 120 | 1.68 | 180.0 | .89 | 133 | 1.68 | 175.5 | 5.3 |

TABLE 5

Lamp type: 125 Watt mercury

| Circuit values: | | L = o.114 H | | C = 20 μf | | Tuning freq. 105.4 | |
|---|---|---|---|---|---|---|---|
| $V_{in}$ | $I_{in}$ | $W_{in}$ | P.F. | $V_{1p}$ | $I_{1p}$ | $W_{1p}$ | $W_{loss}$ |
| 120 | 1.274 | 128.5 | 0.86 | 120.5 | 1.274 | 124.8 | 3.7 |

TABLE 6

Lamp type: 1500 watt metal halide

| Circuit values: | | L = .04 H | | C = 59 μf | | Tuning freq. 104 Hz | |
|---|---|---|---|---|---|---|---|
| $V_{in}$ | $I_{in}$ | $W_{in}$ | P.F. | $V_{1p}$ | $I_{1p}$ | $W_{1p}$ | $W_{loss}$ |
| 277 | 5.92 | 1532 | .924 | 280.2 | 5.92 | 1504 | 28 |

Although the above examples list only one input voltage in each case, it will be recognized that the circuits operate their respective lamps at voltages lower and higher than the listed value. The range of voltages varies from lamp to lamp, again depending on such factors as those noted above and lamp construction.

It will also be recognized that different combinations of circuit component values can be used with most lamps. The lamps can operate with various combinations of values, although such changes may result in different characteristics such as watts actually delivered to the lamp, power factor, dip tolerance, lumen output, immunity to line voltage variation and system L.P.W. achieved. As an example, in the following Table 7 are values used with a 175 watt mercury lamp. The inductor values were changed considerably, the capacitor values being changed very little.

TABLE 7

| Lamp type: 175 watt mercury | | | | | | | |
|---|---|---|---|---|---|---|---|
| $V_{in}$ | $I_{in}$ | $W_{in}$ | P.F. | $V_{1p}$ | $W_{1p}$ | L (H) | C ($\mu$f) |
| 120 | 1.535 | 178 | .961 | 133.1 | 170 | .117 | 28 |
| 120 | 1.665 | 180 | .891 | 134.1 | 176 | .077 | 28 |
| 120 | 1.754 | 180 | .854 | 131.1 | 176 | .067 | 28 |
| 120 | 1.78 | 176 | .819 | 138.7 | 172 | .049 | 27 |
| 120 | 1.87 | 176 | .785 | 138.4 | 173 | .042 | 27 |
| 120 | 1.89 | 176 | .773 | 139.7 | 172 | .0385 | 27 |

In the circuit of the present invention, the lamp can be used as the fixture ON-OFF switch eliminating the need to use expensive special inductive lighting load switches, relays, heavy duty contact types or lighting contractors. The power switch is changed when the lamp is changed.

Figure 13:
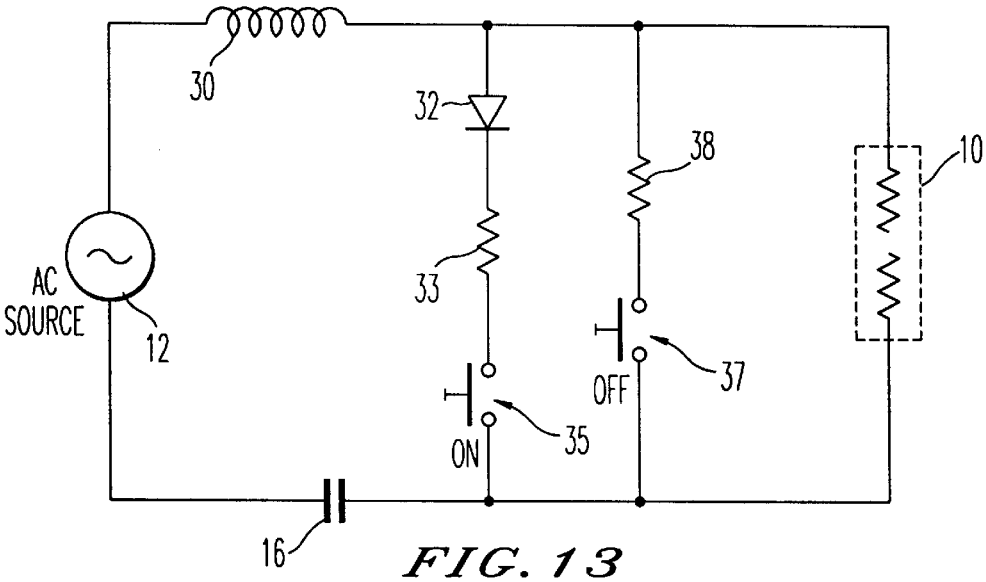
FIG. 13 is a schematic circuit diagram of a lamp operating circuit similar to that of FIG. 7 with one form of power on and off switching by using the lamp itself.

In the above descriptions, there has been no mention of turning the lamp on or off, the assumption being that the AC supply itself was switched. However, it is quite possible to provide simple switching within the circuit of the invention. FIG. 13, which uses the same starting circuit as FIG. 7, illustrates the principle of this and includes a normally open switch 35 in series with diode 32 and resistor 33. The circuit depicted in FIG. 13, which is connected to AC source 12, does nothing until switch 35 is closed. When the switch 35 is closed, charging current begins to flow to capacitor 16 which starts the lamp 10 when the charge on capacitor 16 is sufficiently large. Insofar as the starting function is concerned, switch 35 can be a momentary contact switch or a simple press-to-start switch because the starting circuit is inactive after starting.

A temporary shunt is provided across the lamp to turn off the lamp. In FIG. 13, a momentary contact switch 37 and a current limiting resistor 38 are connected in parallel with the lamp. Briefly closing switch 37 removes the lamp 10 from the circuit of FIG. 13 long enough to cause the lamp to extinguish (deionize), thereby turning off the lamp 10 and the other circuit components shown. For this purpose, it is preferred to have starting switch 35 as a momentary contact switch so that the circuit will not restart when switch 37 is released. It should be noted that the resonant circuit does not start oscillating by itself. Thus, when the system is turned off, it draws no current, a significant advantage over many prior art circuits. Only after the lamp is first ignited by activating the starting switch 35 does the lamp switch or "shock excite" the resonant circuit and start burning. Lamp operation continues until the turn-off switch is pushed.

Another advantage of the circuit of the present invention relates to events which sometimes occur at the end of the life of the lamp. Metal halide lamps sometimes shatter or rupture at the end of lamp life, which may cause hot arc tube material to drop down into the lighted area. To prevent this potential safety hazard, an enclosed fixture with an access door or a shrouded arc tube lamp design is used. However, lamp shattering occurs because driving voltage is conventionally supplied to the lamp from a source which does not respond to lamp activity, i.e., whether the lamp is failing or not, driving voltage is still supplied. However, with the lamp operating circuit of the present invention, this does not occur because the driving voltage depends on lamp switching operation and therefore is not generated as the lamp fails. The OCV simply drops to the line voltage which is too low to drive the lamp at any level.

Figure 14:
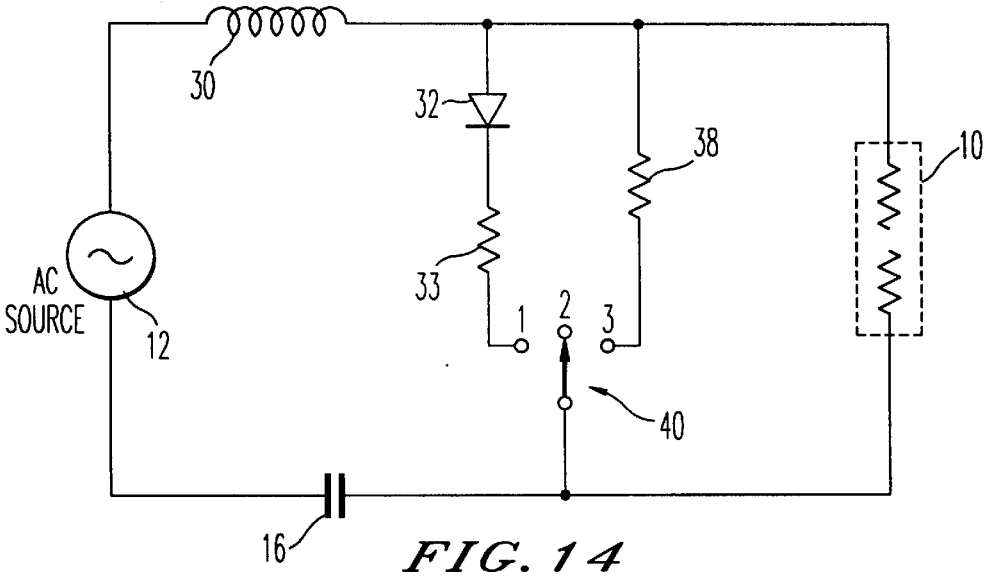
FIG. 14 is a schematic circuit diagram of a lamp operating circuit similar to that of FIG. 7 with a further form of power on and off switching.

The two switch functions can be incorporated into a single on-off switch arrangement as shown in FIG. 14. One terminal of a three-position switch 40 is connected to a starting circuit including diode 32 and resistor 33. A second terminal of the switch is connected to an open circuit, and the third position is connected to the resistor shunt 38 for turning the lamp off. Preferably, the switch is the conventional spring-return-to-center-type so that it occupies the open circuit position unless manually operated. Moving the switch to position 1 starts the lamp, and moving it to position 3 turns the lamp off.

The switches of FIGS. 13 and 14 can also be implemented using semiconductor devices. The "off" circuit can be implemented by connecting a small Triac (not shown) or the like in parallel with the lamp. Turning the Triac on for two or more cycles with a control circuit extinguishes the lamp in the same manner as switch 37. A Triac can also be used to replace switch 35. Because these semiconductor devices are switching limited current and voltage, they need not dissipate great power and can be smaller than relays, switches or other control devices.

The circuit of FIG. 7 has been used with a variety of lamps including high-pressure sodium and mercury lamps in a variety of power ratings with excellent results. With the 400 watt HPS lamp, a 57 $\mu$f capacitor and 0.077 Henry reactor were connected in the circuit and attached to a 120 VAC supply. With an input power of 436 watts, the lamp operated at 409 watts with a lamp voltage of 97.7 and lamp current of 4.92 amps. The power factor was 73.4 and power loss was 27.

Figure 15:
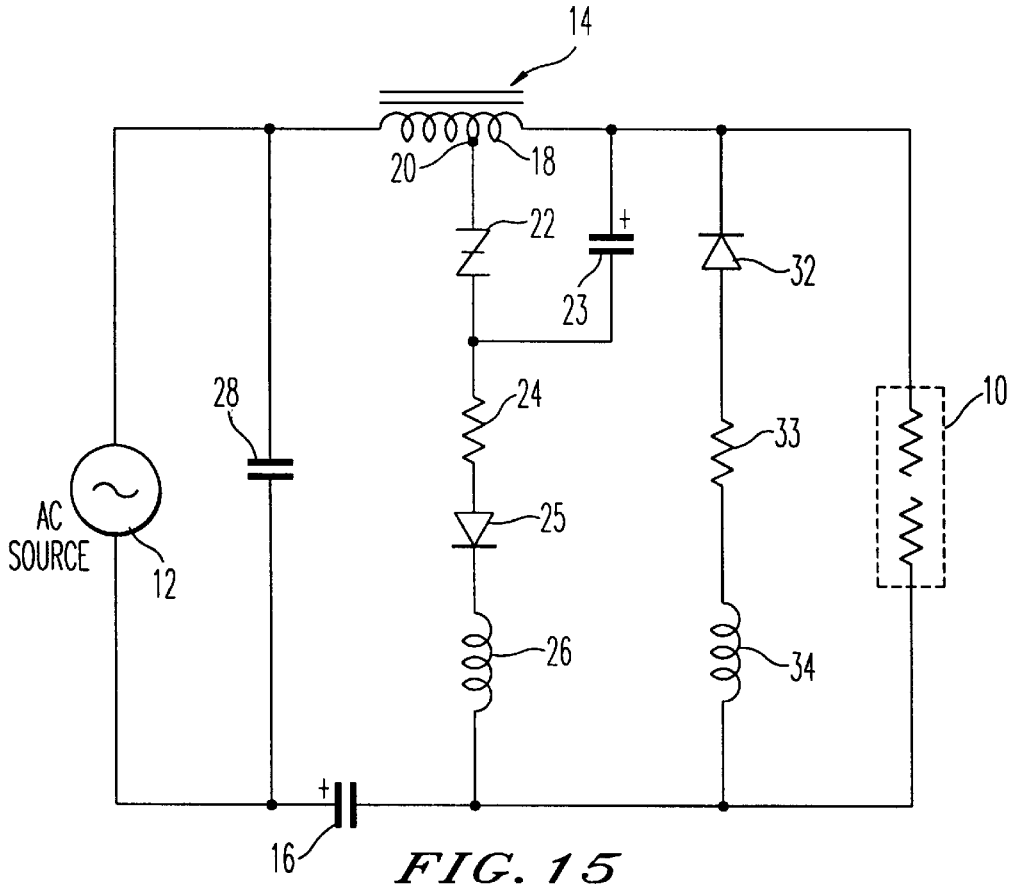
FIG. 15 is a schematic circuit diagram of a further embodiment of a lamp operating circuit in which features of the foregoing circuits are combined.
Figure 24:
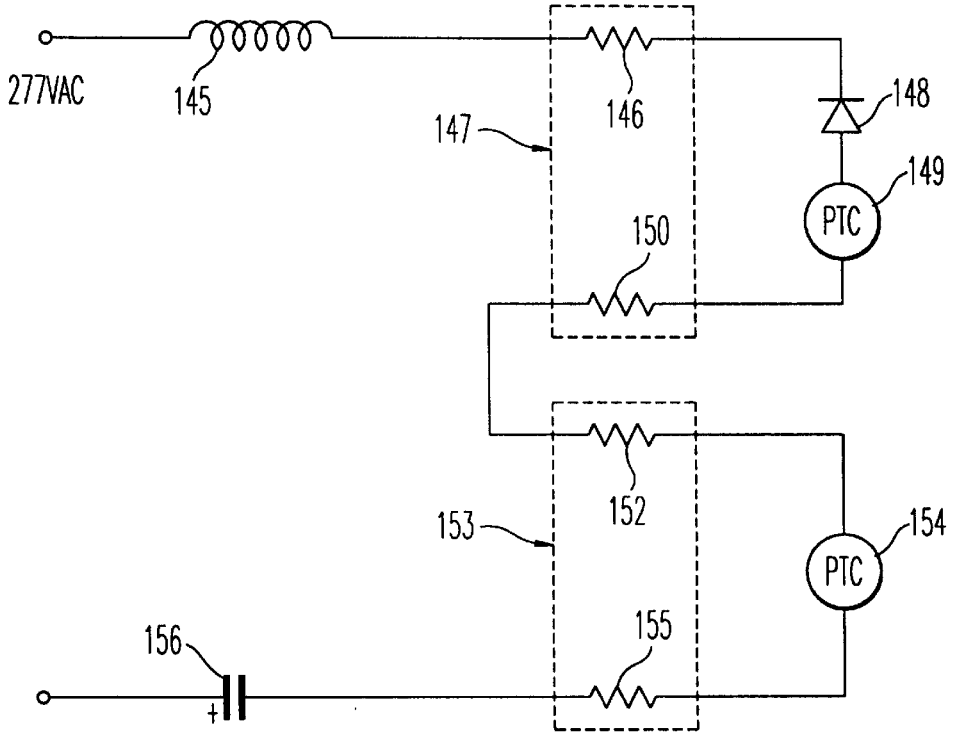
FIGS. 23 and 24 are schematic circuit diagrams of fluorescent lamp starting and operating circuits for operating two lamps together, in parallel and series respectively, in accordance with embodiments of the present invention.

FIG. 15 shows a circuit which incorporates some features of the circuits discussed above. On and off switching has been omitted for simplicity but can be incorporated as previously indicated. The operating circuit of FIG. 15 includes an AC source 12, a bypass capacitor 28 connected in parallel with the source and an inductive reactor 14. A tap 20 on the reactor is connected to the starting circuit which has a Sidac 22 in series with a capacitor 23 connected across end portion 18 of the reactor. A resistor 24 is connected to the junction between the Sidac 22 and capacitor 23 and is in series with a diode 25 and RF choke 26. A separate series circuit including a diode 32, a resistor 33 and a choke 34 is connected in parallel with the lamp. Finally, a capacitor 16, which is selected to resonate with reactor 14, is connected from the lamp to the other side of the AC supply. The operation of the circuit will be understood from the above discussions.

Further variations on the above circuits can be devised using values of L and C for the semi-resonant circuit components to be semi-resonant at frequencies of 2 or more even multiples of the line frequency. This has the important advantage of permitting reduction of the size of circuit components. It is well known that a component such as a capacitor or inductor designed to operate at 120 Hertz can be considerably smaller than a component, otherwise the same electrically, designed to operate at 60 Hertz. With the system of the present invention, the components made to accompany the lamp are no longer limited to the frequency $f_s$ of the AC source and thus can be made smaller. The term "compatible frequency" should therefore be understood to include a frequency $f_k$ which approximates $nf_s$, where n is any even integer.

Figure 16:
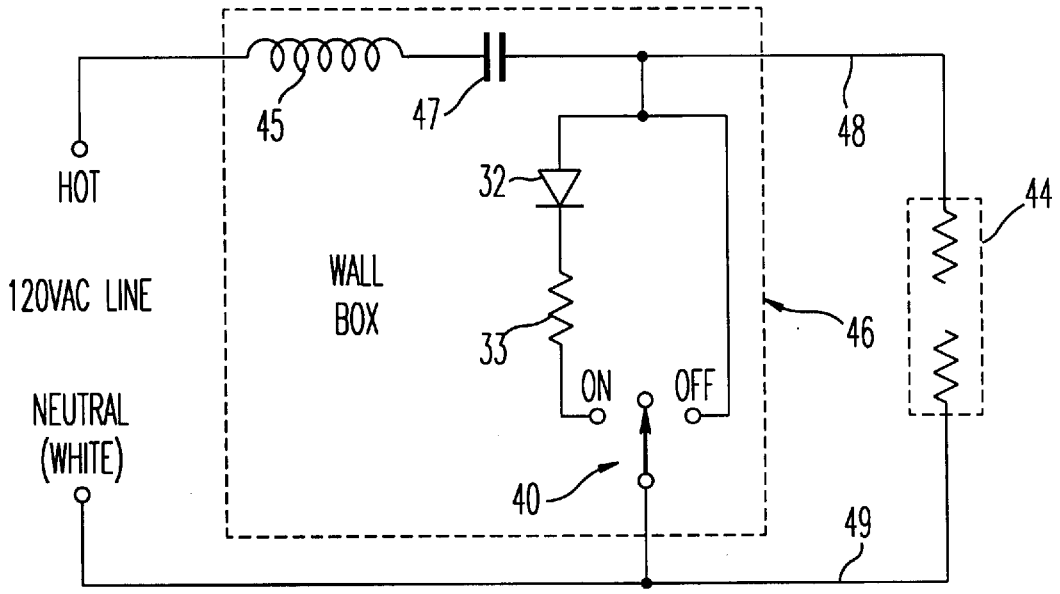
Figure 17:
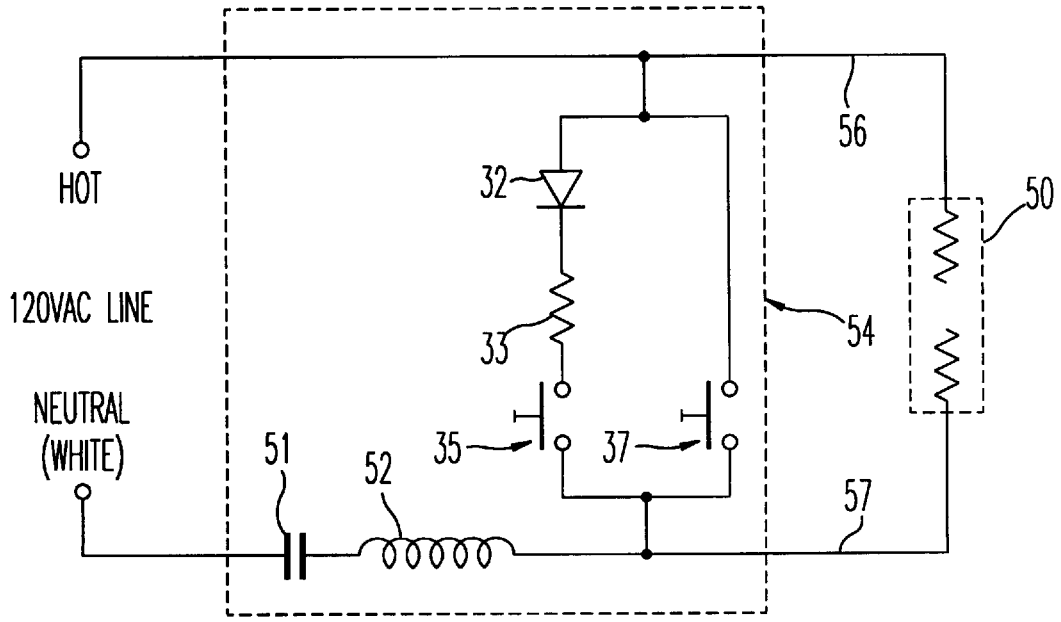

Because of the significantly lower power loss that is an important characteristic of the operating circuit of the present invention, the use of gas discharge lamps such as mercury, HPS and HID lamps and fluorescent lamps becomes feasible for private residences, apartments and offices in contexts which were not practical before. FIGS. 16 and 17 illustrate ways in which these can be implemented.

In FIG. 16, a lamp 44 is connected to a semi-resonant circuit including inductive and capacitive components 45 and 47 which are located in series in the hot wire leading to the lamp. A starting circuit may also be included if necessary, depending on the type of lamp, as discussed above in connection with FIGS. 4 and 7. An on-off circuit of the type shown in FIG. 14 has a switch 40, diode 32 and resistor 33. Switch 40 is movable from the neutral position shown to either the on or off positions and functions as previously described.

Of particular importance is the fact that the circuit components except for the lamp can easily be housed in a wall box 46 of the type normally used for a lever-type on-off switch, and that only two wires 48 and 49 extend to the lamp itself. As a result, wiring for a lamp of this type is no more complicated or expensive that for a conventional incandescent lamp.

FIG. 17 shows another embodiment of a gas discharge lamp 50 arranged for use in a home with the semi-resonant circuit components 51 and 52 in the neutral line and contained within a wall box 54 along with an on and of circuit of the type shown in FIG. 13. This type of on-off circuit uses push button switches and operates as described above. Once again, only two wires 56 and 57 extend from the wall box to the lamp, making the wiring task a simple one.

The use of the lamp as the primary switching element to turn itself on and off when triggered by another switch, as discussed in connection with FIGS. 13 and 14, can be used to great advantage in photocell operation of the lamp. It is common practice to use a photoelectric (PE) control to turn a lamp on when ambient light is low and to turn it off when ambient light is high. Many outdoor luminaries and fixtures employ this technique, but the circuits tend to be unreliable and expensive and have a short life. Not only does the cadmium sulfide (CdS) cell fail under the high wattage to which it exposed in current products, but relay contacts often weld together with chatter and bounce in the reactive loads of ballast-lamp electrical circuits. When these circuits fail, the lamp is left on 24 hours per day until the photoelectric cell is replaced. In accordance with the present invention, when the lamp is changed, the main switching device for the PE function is also changed.

Figure 18:
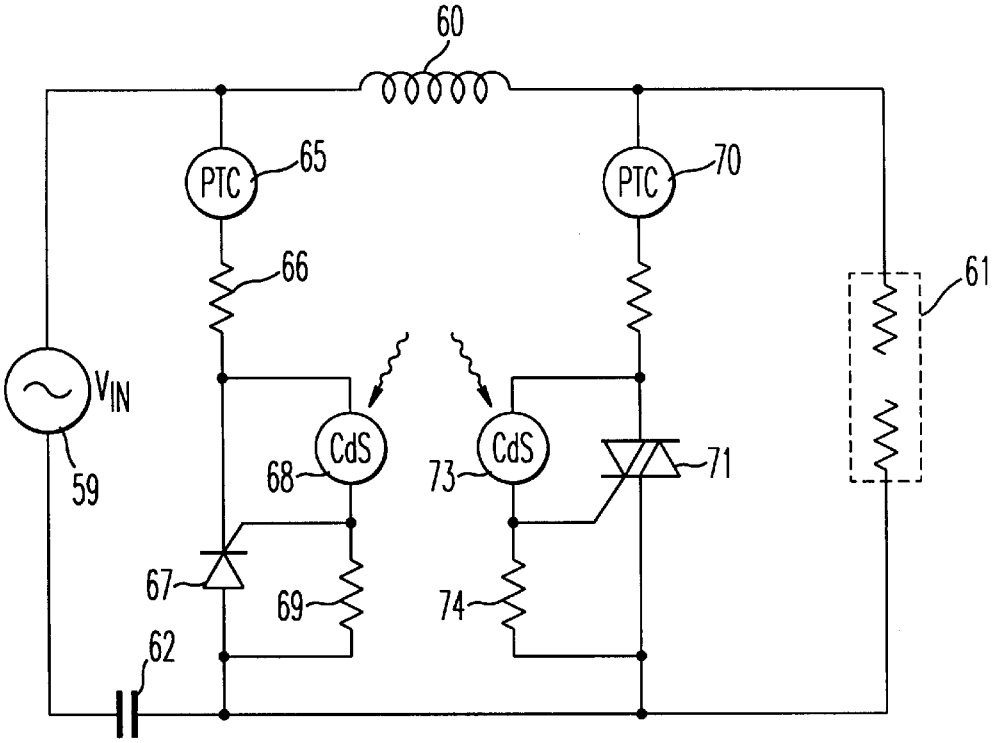
FIGS. 18 and 19 are schematic circuit diagrams of circuits in accordance with embodiments of the present invention with photo-responsive control means.

The circuit of FIG. 18 employs the principle of the present invention. The AC source 59 is connected to a series circuit including an inductive reactor 60, a lamp 61 and a capacitor 62 having values selected as discussed above. A first control circuit is connected across the input side of the reactor and has a PTC resistor 65, a resistor 66 and an SCR 67 in series. A CdS cell 68 and a gate resistor 69 are connected to the gate, anode and cathode of the SCR.

On the other side of the reactor 60 is connected a second control circuit which includes a PTC resistor 70 in series with a Triac 71. A second CdS cell 73 and a gate resistor 74 are connected to the gate, anode and cathode of the Triac 71.

When it is dark, the resistance of CdS cell 68 is high, allowing SCR 67 to be gated into a conductive state (ON) by diode action. Current through this circuit charges capacitor 62 and starts the lamp as previously described. After the lamp starts, the increased resistance of PTC resistor 65 removes this circuit from the system and the lamp continues to operate.

In daylight when the ambient light level is high, the resistance of CdS 73 goes low and triggers Triac 71 on, providing a low resistance path across the lamp and causing it to deionize and extinguish. After the lamp is off, current through the PTC resistor increases its temperature, removing the second control circuit from operation. The lamp is then ready to be started again when daylight disappears.

Figure 19:
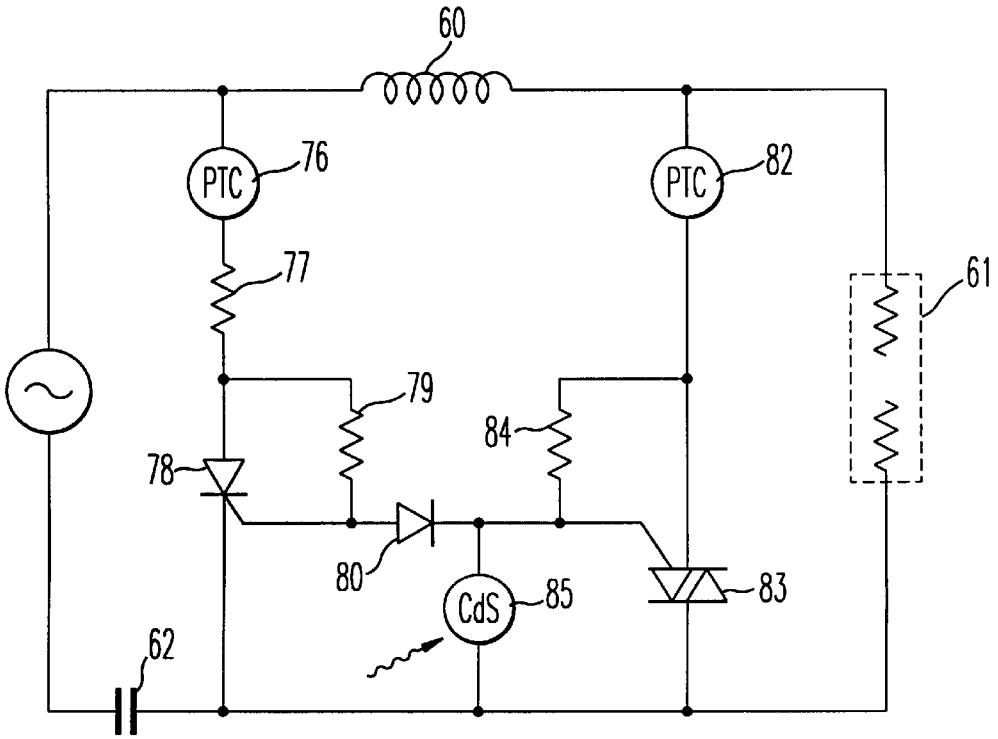

FIG. 19 shows a further embodiment of a circuit which functions in a manner similar to that of FIG. 18, except with only one CdS cell. In FIG. 19, the first control circuit includes a PTC resistor 76 in series with a resistor 77 and an SCR 78. A gate resistor 79 is connected to the gate of the SCR 18 and to a diode 80. The other control circuit includes a PTC resistor 82 in series with a Triac 83. A gate resistor 84 is connected to the Triac gate which is also connected to diode 80. The diode and the gate of the Triac are connected to CdS cell 85.

As with the above circuit, the dark resistance of CdS cell 85 allows SCR 78 to become conductive, starting the lamp. After starting, PTC 76 effectively removes the SCR circuit from operation. When it becomes light, the low, light resistance of the CdS cell triggers Triac into conduction, extinguishing the lamp.

Figure 20:
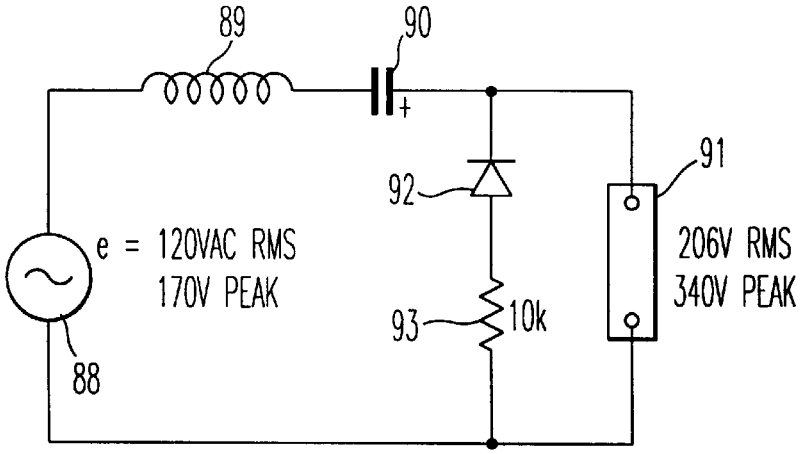
FIG. 20 is a simplified schematic diagram illustrating generation of the starting open circuit voltage.

The development of the open circuit voltage (OCV) which is necessary to start the lamp will now be discussed. For this purpose, reference will be made to the circuit in FIG. 20 which includes an AC source 88, inductor 89 and a capacitor 90 connected in series with a lamp 91. A diode 92 and resistor 93 are connected across the lamp to aid in the development of the required OCV. The AC source is a 120 VAC source which means that the peak value of the source is about 170 volts. With the diode 92 poled as shown, the capacitor 90 charges on the first positive half-cycle of the supply, and a voltage develops that is substantially equal to the peak voltage of the AC source (e.g., about 170 V). In the initial development of the starting OCV, the inductor plays no significant part. The circuit can thus be viewed as a series circuit with an input voltage e in series with the capacitor replaced by a 170 volt battery. The effect of the capacitor/battery voltage is to elevate the input sine wave by the amount of the charge, causing the input voltage to the circuit to vary (in instantaneous values) between 340 volt and zero.

The OCV is then the square root of the sum of the squares of the DC voltage on the capacitor/battery and the RMS value of the AC input, i.e., $$OCV = \sqrt{(V_{dc})^2 + (V_{AC})^2}\ ,$$
$$= \sqrt{(170)^2 + (120)^2}$$
$$208 \text{ V RMS.}$$

In a more general explanation, where $$E = (\sqrt{2})e \text{ and } e = E_{max}\sin\omega t,$$

$$OCV = \sqrt{e^2 + E^2}$$
$$= \sqrt{e^2 + ((\sqrt{2})e)^2}$$
$$= \sqrt{e^2 + 2e^2}$$
$$= \sqrt{3}\ e.$$

Where e=120, the OCV=√e×120=208 volts RMS.

Figure 21:
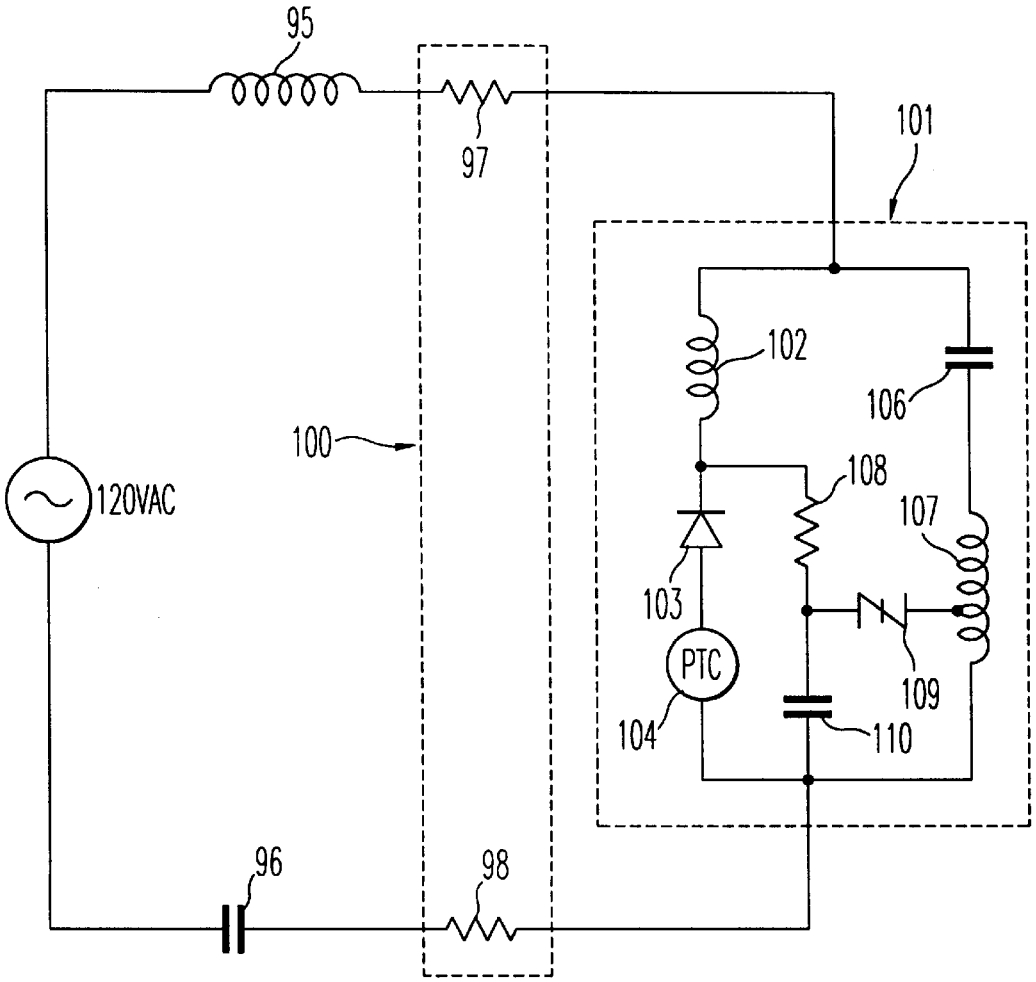
FIGS. 21 and 22 are schematic circuit diagrams of fluorescent lamp starting and operating circuits for operating single lamps in accordance with embodiments of the present invention.

The basic circuit concept of the present invention is also usable with fluorescent lamps in addition to the high intensity discharge lamp; discussed above. FIG. 21 shows a operating circuit including an inductance 95 and a capacitor 96 connected to a 120 VAC source. Lamp filaments 97 and 98 of a fluorescent lamp 100 are connected in series with the inductance-capacitor circuit and with a 26 watt high voltage pulse starting circuit 101. The starting circuit includes a first series circuit having a choke 102 in series with a diode 103 and a PTC resistor 104 across the filaments. A capacitor 106 and a tapped inductor 107 are in series with each other and in parallel with the first circuit. A resistor 108 and a Sidac 109 are connected between diode 103 and the inductor tap and a capacitor 110 is connected between the Sidac and the other side of PTC resistor 104.

Initially,, the PTC resistance 104 is low and filament heating current passes through the first series circuit. This current heats the PTC resistor and elevates its resistance. At the same time, capacitor 110 is charging through resistor 108, the charge level increasing as the PTC resistance increases. When the charge level on capacitor 110 reaches the Sidac breakdown voltage, the capacitor discharges through the Sidac and the tapped end of the inductor 107, generating a pulse which is applied to the lamp. By this time, the lamp filaments are heated and the lamp starts.

Operation of the lamp is similar to that described above in which the lamp itself shocks the L-C circuit 95 and 96 into semi-resonance and switches power between the L-C circuit and the lamp. This will not be described again. In the circuit of FIG. 21, diode 103 can be omitted and its function fulfilled by a series diode-resistance-PTC circuit connected across the input side of the circuit as shown in FIG. 4.

Figure 22:
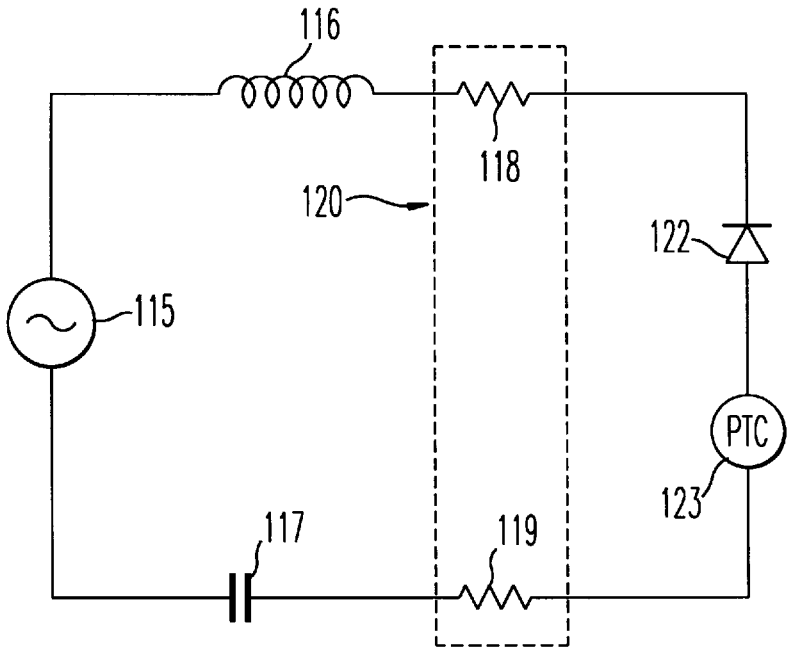

FIG. 22 shows a further embodiment of a fluorescent lamp starting and operating circuit of the present invention in which a 120 VAC source 115 is connected in series with an inductor 116, a capacitor 117, the filaments 118 and 119 of a fluorescent lamp 120 and a starter including a diode 122 and a PTC resistor 123. This circuit uses capacitor 117 for starting. When cold, the PTC resistance 123 is low and heating current flows through the lamp filaments, charging capacitor 117. When the filaments are warm and the voltage on capacitor 117 reaches the required OCV of $\sqrt{3}\times e$, the lamp starts.

Figure 23:
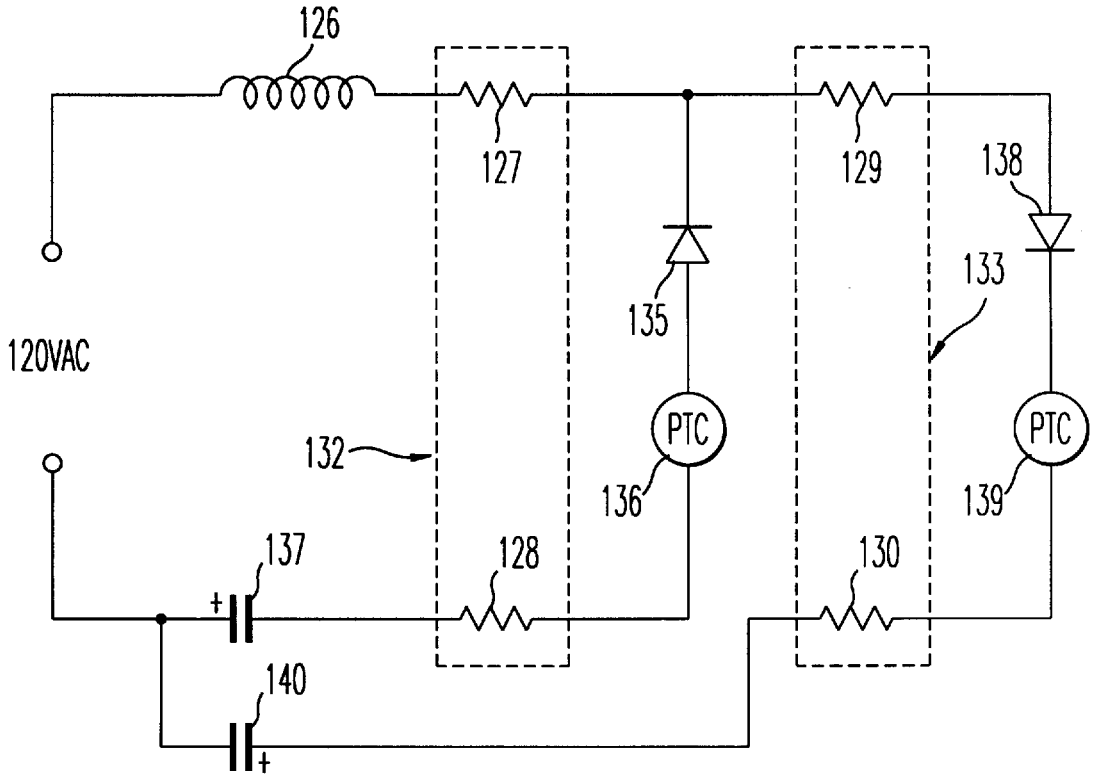

FIG. 23 shows a circuit for operating two fluorescent lamps in parallel and includes an inductance 126 connected to filaments 127 and 129 of lamps 132 and 133, respectively. A diode 135 is connected in series with a PTC resistor 136, with filament 128 of lamp 132 and with a capacitor 137. Similarly, filament 129 is connected in series with a diode 138, a PTC resistor 139 and a capacitor 140. The other sides of both capacitors are connected back to the source. These parallel circuits operate essentially like the circuit of FIG. 22, the individual capacitors 137 and 140 being charged to opposite polarities through their respective diode-PTC circuits while warming the lamp filaments. When sufficient charge and warming has occurred, the lamps start, as described above.

FIG. 23 shows a circuit for operating two fluorescent lamps in series from a 277 VAC source. The source is connected through an inductance 145 to filament 146 of a lamp 147, then through a series circuit including a diode 148 and a PTC resistor 149 and the other filament 150 of lamp 147. The series circuit also includes filament 152 of lamp 153, a PTC resistor 154, the other filament 155 of lamp 153 and through capacitor 156 to the other side of the source. As with any series circuit, the source voltage is divided between the loads but the current is the same throughout. Thus, capacitor 156 is charged through diode 148 and the PTC resistors as the filaments are warmed. When the capacitor reaches the OCV adequate for both lamps and the filaments are warmed, the lamps ignite.

The lamp operating circuit of the present invention uses the discharge breakdown mechanism of the lamp itself each half-cycle of the power source to excite a series connected inductance (L) capacitance (C) into ringing up of an OCV of approximately twice the input voltage to drive the discharge lamp, while using the capacitance magnitude to limit the charge moving through the lamp to the correct value, thereby setting the lamp operating wattage to the correct value. Thus, the need to put a switching silicon power semiconductor switch in a high frequency ballast circuit (switching regulator or power supply approach) for a discharge lamp is eliminated because the discharge lamp itself is a switching gaseous power semiconductor equivalent. With the proper semi-resonant power loop and lamp control circuitry, the lamp itself becomes the switching function generator, reducing the need for or the power handling demand placed on the silicon devices used to create the lamp turn-on (power pulsing) then turn-off (to control power) sequence used in the high frequency ballast technology of today. Since this basic approach of using the lamp to effect lamp driving voltage amplification and switching to process energy pulses to the lamp in a controlled manner applies to high frequency ballasting techniques and not only to 50 Hz and 60 Hz circuits, for example, a special fast ionization and de-ionization gas discharge lamp, or eventually a semiconductor circuit lamp having the breakdown characteristic designed in, can be constructed to operate at kilohertz or megahertz frequencies, and be very compact and fed by a 60 Hz line.

While certain advantageous embodiments have been chosen to illustrate the invention, it will be understood by those skilled in the art that various modifications can be made therein without departing from the scope of the invention as defined in the appended claims.

What is claimed is:

1. A discharge lamp operating circuit comprising:

a source of alternating current (AC) voltage at a predetermined frequency;

a discharge lamp; and a series resonant circuit connected to said source of alternating current voltage and in series with said lamp, said resonant circuit being tuned to a frequency higher than said predetermined frequency, said lamp intermittently switching at a rate between said predetermined frequency and said tuned frequency to stimulate said series resonant circuit into oscillation and said series resonant circuit maintaining said lamp in operation.

2. A circuit according to claim 1, wherein said source of voltage operates substantially at a single frequency and said resonant circuit has a fundamental frequency close to said single frequency.

3. A circuit according to claim 1, wherein said source of voltage operates substantially at a single frequency and said resonant circuit has a fundamental frequency which is an even integral multiple of said single frequency.

4. A circuit for operating a discharge lamp connected to an alternating current power source comprising:

a discharge lamp being characterized by an operating voltage; and a resonant circuit comprising an inductor and a capacitor connected in series with said lamp and operable at least semi-resonantly therewith, wherein said lamp excites said resonant circuit substantially every half-cycle of said power source, and said resonant circuit generates current pulses to drive said lamp at said operating voltage in response to said lamp excitation, said lamp operating as a switch substantially every half-cycle of said power source, igniting itself using said current through said resonant circuit to drive itself and to sustain said operating voltage and at least semi-resonant power transfer from said resonant circuit to said lamp, without a separate switching element connected to said lamp for controlling said switching operation.

5. A discharge lamp operating circuit according to claim 4, wherein said operating voltage is greater than source voltage generated by said power source.

6. A discharge lamp operating circuit according to claim 4, wherein the value of said capacitor is selected to limit current through said lamp from said power source to operate said lamp at a desired lamp operating wattage.

7. A discharge lamp operating circuit according to claim 6, wherein said resonant circuit operates at a frequency greater than the line voltage frequency of said power source and said value of said capacitor is selected such that current flowing therethrough and through said lamp is substantially equivalent to $2\pi fCV_c10^{-6}$, C being the value of said capacitor, f being said resonance frequency and $V_c$ being voltage measured across said capacitor.

8. A discharge lamp operating circuit according to claim 4, wherein the value of said inductor being selected to operate said resonant circuit at a frequency greater than the line voltage frequency of said power source to allow said excitation of said resonant circuit by said lamp during substantially every half-cycle of said power source.

9. A discharge lamp operating circuit according to claim 4, further comprising a circuit element comprising a switch connected in parallel with said lamp, said circuit element being operable to short circuit said lamp when said switch is closed to power down said lamp.

10. A discharge lamp operating circuit according to claim 4, wherein said lamp is operable as a switch and discontinues excitation of said resonant circuit when said lamp fails, said operating voltage decreasing to said source voltage, said source voltage being insufficient to drive said lamp into operation.

11. A discharge lamp operating circuit according to claim 4, further comprising a starting circuit connected in parallel with said lamp for charging said capacitor to a voltage greater than said source voltage to initiate ionization of said lamp.

12. A discharge lamp operating circuit according to claim 11, wherein said starting circuit comprises a diode and a current limiting resistor connected in series.

13. A discharge lamp operating circuit according to claim 4, further comprising a starting circuit and wherein said inductor comprises a tap, said starting circuit comprising a thyristor and a capacitor connected in series with each other and in parallel with a portion of said inductor extending between said tap and one end of said inductor, a first resistor connected at one end thereof to the junction between said thyristor and said capacitor, a diode connected at one end thereof to said first resistor, a choke having one end thereof connected to the other end of said first resistor and the other end thereof connected to said lamp, and a positive temperature coefficient resistor and a second resistor connected in series with respect to each other and the ends of the series circuit being connected to the inductor and the capacitor, respectively.

14. A discharge lamp operating circuit according to claim 4, wherein said lamp is connected in series between said inductor and said capacitor.

15. A discharge lamp operating circuit according to claim 4, wherein said capacitor is connected in series between said inductor and said lamp.

16. A discharge lamp operating circuit according to claim 4, wherein said inductor is connected in series between said capacitor and said lamp.

17. A discharge lamp operating circuit according to claim 4, wherein the value of said inductor and said capacitor are selected such that lamp impedance $Zo=(L/C)^{1/2}$ is close in value to dissipating resistance associated with said lamp and said power transfer is maximized.

18. A discharge lamp operating circuit according to claim 4, wherein said lamp is selected from the group consisting of a fast ionization and deionization lamp, a semiconductor circuit lamp configured to break down every half-cycle of said power source to excite said resonant circuit, a metal halide lamp, a mercury vapor lamp, a high pressure sodium lamp, and a fluorescent lamp.

19. A method of operating a discharge lamp comprising:

selecting an inductor and a capacitor having values selected to resonate as a series resonant circuit at a selected frequency;

connecting the inductor and capacitor in series with a discharge lamp;

connecting the series circuit of inductor, lamp and capacitor to a source of alternating voltage operating at a frequency below said selected frequency; and initiating discharge of the lamp whereby the series resonant circuit is intermittently shocked into resonance by said lamp at a frequency between said frequency of said source and the selected frequency to exchange energy between the source and lamp, and the exchange of energy maintains the lamp in operation.

20. A method according to claim 19, wherein the source of alternating voltage has a root mean square (RMS) magnitude less than an open circuit voltage required to operate the lamp.

21. A method of operating a discharge lamp provided with power by an alternating current power source, comprising the steps of:

connecting a resonant circuit comprising an inductor and a capacitor in series with said lamp; and exciting said inductor and said capacitor substantially every half-cycle of said power source using an internal switching characteristic of said lamp, said lamp and said resonant circuit cooperating together to at least semi-resonantly transfer power therebetween.

22. A method according to claim 21 wherein said connecting step further comprises the steps of:

determining the amount of current necessary to operate said lamp at a desired wattage; and selecting the value of said capacitor to limit current flowing from said power source through said lamp to sustain said operating wattage.

23. A method according to claim 22, wherein said selecting step comprises the step of selecting the value of said capacitor such that current flowing therethrough and through said lamp is substantially equivalent to $2\pi fCV_c10^{-6}$, C being said value of said capacitor, f being said resonance frequency and $V_c$, being voltage measured across said capacitor.

24. A method according to claim 21, wherein said connecting step further comprises the step of selecting the value of said inductor to operate said resonant circuit at a frequency greater than the frequency of said power source.

25. A method according to claim 21, wherein said exciting step comprises the step of exciting said resonant circuit at a resonance frequency greater than the line voltage frequency of said power source.

26. A method according to claim 21, wherein said exciting step comprises the steps of op era ting said lamp itself as a switch to eliminate a need for circuit means to step up source voltage to drive said lamp and control means to controllably switch said lamp, and reducing at least one operating characteristic selected from the group consisting of size of enclosure for said resonant circuit and said lamp, weight of said lamp and operating circuitry associated therewith, and heat generation of said lamp.

* * * * *